US010207785B2

(12) United States Patent
Woody

(10) Patent No.: US 10,207,785 B2
(45) **Date of Patent: *Feb. 19, 2019**

(54) WATERCRAFT ADJUSTABLE SHAFT SPACING APPARATUS AND RELATED METHOD OF OPERATION

(71) Applicant: Platinum Marine Inc., Pinconning, MI (US)

(72) Inventor: Clark M. Woody, Pinconning, MI (US)

(73) Assignee: Platinum Marine Inc., Pinconning, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/948,062

(22) Filed: Apr. 9, 2018

(65) Prior Publication Data

US 2018/0222563 A1 Aug. 9, 2018

Related U.S. Application Data

(63) Continuation of application No. 15/622,757, filed on Jun. 14, 2017, now Pat. No. 9,969,476, which is a (Continued)

(51) Int. Cl.

| | |
|---|---|
| ***B63H 20/18*** | (2006.01) |
| ***B63H 21/14*** | (2006.01) |
| ***B63H 23/06*** | (2006.01) |
| ***B63H 5/125*** | (2006.01) |
| ***B63H 20/10*** | (2006.01) |
| ***B63H 20/12*** | (2006.01) |
| ***B63H 20/20*** | (2006.01) |

(Continued)

(52) U.S. Cl.

CPC ..... *B63H 20/18* (2013.01); *B63H 5/125* (2013.01); *B63H 20/106* (2013.01); *B63H 20/12* (2013.01); *B63H 20/20* (2013.01); *B63H 21/14* (2013.01); *B63H 23/06* (2013.01); *B63B 2758/00* (2013.01); *B63H 2020/025* (2013.01); *B63H 2020/145* (2013.01); *B63H 2023/062* (2013.01)

(58) Field of Classification Search

CPC ..... B63H 5/125; B63H 23/06; B63H 21/14; B63H 20/18

See application file for complete search history.

(56) References Cited

U.S. PATENT DOCUMENTS 1,780,552 A 11/1930 Coggins et al.
2,667,087 A 1/1954 Myers
(Continued)

*Primary Examiner* — Stephen P Avila
(74) *Attorney, Agent, or Firm* — Warner Norcross + Judd, LLP

(57) ABSTRACT

An outdrive for a marine vessel, such as a watercraft having an inboard engine, is provided. The outdrive can include a standoff box joined with a drive unit having a driveshaft that rotates in response to rotation of an input shaft coupled to an engine within a hull of the watercraft. The drive unit includes a propeller shaft that rotates in response to rotation of the driveshaft, and an associated propeller. The drive unit is vertically movable from a raised mode to a lowered mode, in which the propeller shaft is a preselected distance from a bottom of the boat hull, thereby lowering a thrust point produced by the propeller, all while the watercraft is moving through water and while the propeller is producing thrust. A related method and standoff box are also provided.

20 Claims, 20 Drawing Sheets

Related U.S. Application Data continuation-in-part of application No. 15/464,592, filed on Mar. 21, 2017, now Pat. No. 9,758,225, which is a continuation of application No. 15/411,511, filed on Jan. 20, 2017, now Pat. No. 9,708,045.

(60) Provisional application No. 62/358,334, filed on Jul. 5, 2016, provisional application No. 62/362,829, filed on Jul. 15, 2016, provisional application No. 62/370,031, filed on Aug. 2, 2016.

(51) Int. Cl.
*B63H 20/02* (2006.01)
*B63H 20/14* (2006.01)

(56) References Cited

U.S. PATENT DOCUMENTS

| | | | |
|---|---|---|---|
| 2,705,468 | A | 4/1955 | Dix |
| 2,957,441 | A | 10/1960 | Leipert |
| 3,626,467 | A | 12/1971 | Mazziotti |
| 4,244,454 | A | 1/1981 | Bankstahl |
| 4,544,362 | A | 10/1985 | Arneson |
| 4,565,532 | A | 1/1986 | Connor |
| 4,645,463 | A | 2/1987 | Arneson |
| 4,728,308 | A | 3/1988 | Weismann |
| 4,764,032 | A | 8/1988 | Tanaka |
| 4,775,342 | A | 10/1988 | Connor et al. |
| 4,790,782 | A | 12/1988 | McCormick |
| 4,815,996 | A | 3/1989 | Carr |
| 5,326,294 | A | 7/1994 | Schoell |
| 5,415,576 | A | 5/1995 | Meisenburg et al. |
| 5,647,780 | A | 7/1997 | Hosoi |
| 5,791,954 | A | 8/1998 | Johnson, Jr. |
| 5,863,230 | A | 1/1999 | Morrison |
| 5,934,955 | A | 8/1999 | Heston |
| 5,964,627 | A | 10/1999 | Detwiler |
| 6,383,043 | B1 | 5/2002 | Heston |
| 6,431,927 | B1 | 8/2002 | Sage |
| 6,468,119 | B1 | 10/2002 | Hasl et al. |
| 6,523,655 | B1 | 2/2003 | Behara |
| 6,960,107 | B1 | 11/2005 | Schaub et al. |
| 7,163,427 | B1 | 1/2007 | Lee |
| 7,985,109 | B2 | 7/2011 | Mansfield et al. |
| 9,969,476 | B2 * | 5/2018 | Woody ..... B63H 20/106 |
| 2009/0117791 | A1 | 5/2009 | Huddleston |

* cited by examiner

WATERCRAFT ADJUSTABLE SHAFT SPACING APPARATUS AND RELATED METHOD OF OPERATION

BACKGROUND OF THE INVENTION

The present invention relates to watercraft, and more particularly to a watercraft outdrive that can move a propeller and its shaft relative to a watercraft bottom while the watercraft is under power.

There is a variety of watercraft used in different activities. Some watercraft is used for commercial purposes, while others are used for recreation and/or competition. Many watercraft or boats are constructed to include an inboard motor. In such a construction, the engine of the boat is located inside the hull of the boat, while an outdrive projects rearward from the stern of the boat. The outdrive typically includes a transmission that transfers rotational forces from the engine to a propeller shaft and an associated propeller. Upon rotation, the propeller produces thrust to propel the boat through water.

Conventional outdrives of inboard watercraft typically are constructed so that the outdrive can tilt about a pivot point tilt the propeller upward or tilt the propeller downward. Upon such tilting, however, the angle of the propeller and the associated thrust changes significantly. For example, when an outdrive is tilted upward, the tilted angle of the propeller makes maneuvering the boat more difficult because the thrust is projected upward toward the water surface instead of being projected rearward, behind the boat.

Even with such tilt features an issue with conventional outdrives of inboard watercraft is that the vertical displacement of the propeller shaft and propeller is generally fixed and immovable relative to the bottom of the watercraft. With this fixed relationship relative to the bottom of the watercraft, conventional outdrives fail to effectively provide vertical adjustment of the propeller shaft and propeller, and thus the thrust point.

The fixed relationship of the propeller shaft relative to the bottom of the boat also presents challenges to boat builders. To mount a standard drive at the surface of water, the builder will mount the engine higher within the hull of the boat. This in turn raises the center of gravity of the boat and in some cases makes it unstable. Raising the center of gravity also can impair the boat's handling characteristics. This can create issues, particularly when the boat turns at high-speed.

With a given height of the engine above the bottom of the boat, boat builders also struggle to identify the ideal propeller shaft location relative to the bottom of the boat when setting it in that fixed, permanent position. Usually, the builder uses trial and error techniques to place the propeller shaft at a particular location. Some boat builders and consumers will attempt to change the location of the propeller shaft relative to the bottom of the boat. For example, a consumer might purchase an outdrive lower unit that differs from the OEM lower unit offered at a standard height. These outdrive lower units typically enable the user to adjust the propeller shaft location in one inch increments.

An issue with modifying the outdrive to replace one lower unit for another is that this modification must be done by disassembling the outdrive and its components out of the water. This can be time-consuming and expensive. Users also can utilize spacer plates that are placed between upper and lower units of the outdrive. Again, however, the final set up of the spacer plate and/or different lower unit is fixed and cannot be changed without disassembling the lower unit to add or subtract a spacer plate or to replace the lower unit altogether with a different sized lower unit.

Another complicating factor in finding the ideal propeller shaft location is that the configuration and loading of the watercraft can change what that ideal propeller shaft location should be. For example, when a watercraft is loaded with gear and occupants on board, this can alter the ideal propeller shaft location. Full or empty fuel tanks also can change the location.

Further, with a fixed and immovable propeller shaft location, conventional outdrives can limit performance, particularly in race boats. Race boats typically run the propeller shaft at the surface of the water when the boat is under power to maximize speed. When the race boat turns around an obstacle, such as a buoy, at speed, less skeg of the outdrive is in the water. With less skeg in the water, the boat is more prone to skim the surface of the water and potentially spin out. In some cases, this can create a dangerous situation for the racers as well as observers.

Surface drive boats with a fixed and immovable propeller shaft location also are difficult to maneuver around a dock or other obstacle where a reverse direction is helpful. For example, surface drive propellers, when in reverse, thrust water against the stern, and in particular the transom of the boat. This helps very little to propel the boat rearward because this thrust is wasted.

Accordingly, there remains room for improvement in the field of outdrives for watercraft with inboard motors.

SUMMARY OF THE INVENTION

An outdrive for a marine vessel, such as a watercraft, that can move a propeller and its shaft relative to a watercraft bottom while the vessel is under power is provided.

In one embodiment, the outdrive is joined with a watercraft having an inboard engine. The outdrive can include a standoff box having a transfer shaft that rotates in response to rotation of an input shaft coupled to the inboard engine. The standoff box can include a secondary shaft that rotates in response to rotation of the transfer shaft, and subsequently rotates a driveshaft of a drive unit. The drive unit includes a propeller shaft, and an associated propeller, that rotate in response to rotation of the driveshaft. The drive unit is vertically movable relative to the standoff box.

In another embodiment, the drive unit is movable from a raised mode, in which the propeller shaft is a first distance from a reference line extending rearward from the transom, to a lowered mode, in which it is a second distance, greater than the first distance, from the reference line. This lowers a thrust point produced by the propeller, all while the watercraft is moving through water and while the propeller is producing thrust.

In a further embodiment, the drive unit moves relative to the standoff box so that in both the raised mode and the lowered mode, the propeller shaft is maintained at a fixed angle relative to a reference line projecting rearward from a bottom of a transom of the watercraft. In this manner, the propeller shaft is inhibited from and generally does not tilt longitudinally relative to the reference line. Instead, the propeller shaft simply moves vertically, upward and downward, while maintaining a fixed spatial orientation relative to the transom and a reference line.

In another embodiment, the outdrive can be equipped with a tilt assembly configured to tilt the outdrive up and down relative to the transom or hull of the watercraft. The tilt assembly can include a tilt actuator joined with the drive unit. The tilt actuator can extend to tilt the drive unit upward thereby changing the angle of the propeller shaft relative to the reference line. The tilt actuator can retract to tilt the drive unit downward, thereby changing the angle of the propeller shaft relative to the reference line. This tilting action is different from the vertical adjustment of the propeller shaft placement when the drive unit is moved from the raised mode to the lowered mode or vice versa. In the latter case, the propeller shaft can be maintained at a fixed angle relative to the bottom of the watercraft and/or the reference line all during the vertical movement of the drive unit relative to the standoff box.

In even another embodiment, the outdrive can include a drive assembly. The drive assembly can include moving components in the standoff box, as well as in the drive unit, that ultimately rotate the propeller shaft in response to rotation of the input shaft extending from the engine.

In still another embodiment, the drive assembly can include, in the standoff box, the transfer shaft rotatably coupled to the input shaft. A transfer gear can be non-rotatably fixed to the transfer shaft so that the transfer gear rotates in unison with the transfer shaft. The transfer gear can be linearly movable along a longitudinal axis of the transfer shaft. The secondary shaft can be rotatable in response to rotation of the transfer shaft, and can extend from the standoff box and into the drive unit, where it is rotatably coupled to the driveshaft.

In yet another embodiment, the drive assembly can include a ball spline through which the transfer shaft extends. The ball spline can be configured to allow the transfer shaft to move linearly through the ball spline and/or along a longitudinal axis of the ball spline. The ball spline, however engages the transfer shaft so that the ball spline and transfer shaft do not rotate relative to one another. The transfer shaft and ball spline rotate together in unison when the ball spline is rotated. The ball spline and transfer shaft can be in fixed and non-rotatable relative to one another.

In another embodiment, the drive assembly can include a spline connection associated with the transfer shaft and configured to enable the transfer gear to move linearly along a transfer shaft longitudinal axis. For example, the transfer shaft can include a first shaft portion and a second shaft portion joined via a spline connection. The first shaft portion and second shaft portion are linearly movable relative to one another along a transfer shaft longitudinal axis. Where the transfer gear is joined with the first or second shaft portion, when those portions move, the transfer gear also moves along the transfer shaft longitudinal axis. As another example, the transfer gear can define a spline hole, and the transfer shaft can be keyed to that spline hole. The transfer gear thus can be rotationally fixed to the transfer shaft but linearly movable along the transfer shaft and the corresponding transfer shaft longitudinal axis.

In a further embodiment, the drive assembly can include a transfer block movably disposed in the standoff box. The transfer block can be joined with the transfer shaft but non-rotatable within the interior of the housing. The transfer block, however, can be linearly movable along the transfer shaft, toward and away from a bottom wall of the standoff box. Optionally, the transfer gear and secondary shaft can be rotatably mounted to the transfer block. The transfer block can maintain the transfer shaft, transfer gear and secondary shaft in a fixed spatial orientation relative to one another during rotation of those components.

In yet another embodiment, the outdrive can include a guide assembly. The guide assembly can include one or more guide shafts that guide the transfer block up and down in the standoff box along a uniform, generally linear path when the drive unit moves relative to the standoff box. The guide shafts can each respectively be movably disposed within one or more guide shaft bores defined by the transfer block.

In still another embodiment, the outdrive can include a vertical adjustment assembly that moves the drive unit relative to the standoff box. This vertical adjustment assembly can include a spacing actuator, such as a hydraulic cylinder, that is joined with the drive unit as well as the standoff box. The spacing actuator can extend and retract, and thereby move the drive unit upward and downward. In turn, this alters the spacing between the propeller shaft and the reference line of the transom, or more generally the spacing of the propeller shaft relative to a lowermost portion and/or a bottom wall of the standoff box.

In still yet a further embodiment, a standoff box for a watercraft having an inboard engine is included in the outdrive. The standoff box can include a housing that defines an interior. The housing can include a transom facing wall, a bottom wall and a rearward wall. The transom facing wall can define an input shaft hole adapted to receive therethrough an input shaft extending from the inboard motor. The rearward wall can define a secondary shaft hole adapted to receive therethrough a secondary shaft extending to the drive unit. This secondary shaft hole can include a secondary shaft hole axis, and optionally can be in the form of an elongated, vertically oriented slot. Further optionally, the transom facing wall and rearward wall can be non-parallel with one another, the rearward wall being substantially vertical and the transom facing wall being at an angle offset from vertical.

In a further embodiment, the standoff box of the outdrive can include a transfer shaft rotatably mounted in the housing, and disposed transverse to the input shaft when the input shaft is received by the input shaft hole. The transfer shaft can include a transfer shaft longitudinal axis. A transfer gear can be non-rotatably fixed to the transfer shaft so that the transfer gear rotates in unison with the transfer shaft, however, the transfer gear can be linearly movable along the transfer shaft longitudinal axis. The standoff box can include a secondary shaft extending from the housing through the secondary shaft hole. The secondary shaft can be movable linearly along the secondary shaft hole axis so that the secondary shaft is movable toward and away from the bottom wall of the housing as the secondary shaft rotates.

In even a further embodiment, a method of operating an outdrive is provided. The method can include: rotating an input shaft extending from a transom of a watercraft; rotating a transfer shaft coupled to the input shaft, the transfer shaft disposed in a standoff box having a bottom wall; rotating a secondary shaft coupled to the transfer shaft, the secondary shaft disposed in the standoff box; rotating a driveshaft coupled to the secondary shaft, the driveshaft disposed in an outdrive; rotating a propeller shaft coupled to the driveshaft, the propeller shaft joined with a propeller; and moving the propeller shaft away from the bottom wall a preselected distance while rotating the driveshaft and propeller shaft, the moving occurring while the propeller spins and the watercraft is moving through a body of water.

In yet a further embodiment, the outdrive can be outfitted with a secondary shaft that includes a double articulating joint. This can enable the drive unit to articulate well relative to the standoff box. Optionally, the centers of rotation of the double articulating joint can be coincident with an axis of rotation of a gimbal ring and/or a mounting bracket so that the components do not bind when the drive unit is turned and/or tilted.

In still yet a further embodiment, the outdrive can include a split standoff box. The split standoff box can include an upper standoff box unit and a lower standoff box unit. The lower standoff box unit can be coupled to a drive unit, so that those units can move relative to the upper standoff box unit during raising and lowering operations. Optionally, a transfer shaft can move relative to a ball spline unit disposed in the upper standoff box unit. The ball spline and the transfer shaft can continue to rotate yet move linearly with the lower standoff box unit during a raising and/or lowering operation.

In even a further embodiment, the outdrive can include a split standoff box joined with a drive unit. A tilt actuator, such as a pneumatic hydraulic or other cylinder can extend between and can include a first end joined with a bracket on the drive unit and a second end joined with a bracket having a cylindrical sleeve so that bracket can swivel relative to a guide assembly and/or a portion of the split standoff box during a watercraft turning operation. The bracket with a sleeve also can be vertically movable up and down relative to the standoff box, and optionally can maintain a predetermined angle between the actuator and the drive unit during such movement.

The current embodiments of the watercraft outdrive and related method herein provide benefits in watercraft propulsion that previously have been unachievable. For example, where the outdrive is utilized on watercraft, the adjustability of the drive unit relative to the standoff box vertically allows an operator to lower a thrust point of the propeller to gain leverage and lift the bow of the watercraft. This can assist the watercraft in getting on plane more quickly. Further, with the vertical adjustability of the propeller shaft and drive unit in general, a user can adjust upward the thrust point after the watercraft is on plane to reduce drag and increase efficiency and speed.

Where the outdrive is configured to selectively vertically adjust thrust point and general orientation of the propeller shaft, a boat manufacturer can mount an inboard engine in the boat at a lower position in the hull. This can lower the center of gravity of the watercraft, but with the adjustable outdrive, the watercraft can still operate the propeller at the surface of the water upon demand.

With the vertical spacing adjustability of the outdrive, the location of the propeller shaft and associated thrust point of the propeller can be changed without disassembling or otherwise mechanically modifying the outdrive. In addition, when the watercraft is loaded with gear, payload and occupants, which alters the buoyancy of the watercraft, an operator can adjust the outdrive, even when the watercraft is under power and moving through the water, to ideally set the propeller shaft location. The operator also can adjust the outdrive depending on the amount of fuel in fuel tanks on the watercraft.

The vertical spacing adjustability of the outdrive herein can enable a user to lower a propeller shaft when entering a turn. This can increase drag and slow the boat more quickly. With a lowering of the lower unit of the outdrive, the outdrive also has more skeg and surface area in the water, which can prevent the boat from spinning out when traversing turns at high speed. Accordingly, boats equipped with such an outdrive can traverse turns at a higher rate of speed. Further, after the boat leaves the turn and straightens its path, the user can raise the propeller shaft to again obtain a high rate of speed.

The vertical spacing adjustability of the outdrive herein can assist in movement of the watercraft in reverse. For example, a user can lower the lower drive unit to adjust the propeller shaft and propeller location relative to the bottom of the watercraft. In effect, the lower unit can be lowered so that the propeller shaft and propeller are below the bottom of the watercraft, where the thrust can easily pass under the watercraft, rather than push against the transom of the watercraft.

The vertical spacing adjustability of the outdrive herein also can allow the outdrive to operate in shallow water. For example, with the outdrive, a user can raise the propeller shaft and propeller, which in turn can reduce the required water depth for operation without engaging the propeller against the bottom of the body of water, all while keeping the forward thrust produced by the propeller in line with the watercraft to maximize handling in the shallow water.

These and other objects, advantages, and features of the invention will be more fully understood and appreciated by reference to the description of the current embodiment and the drawings.

Before the embodiments of the invention are explained in detail, it is to be understood that the invention is not limited to the details of operation or to the details of construction and the arrangement of the components set forth in the following description or illustrated in the drawings. The invention may be implemented in various other embodiments and of being practiced or being carried out in alternative ways not expressly disclosed herein. Also, it is to be understood that the phraseology and terminology used herein are for the purpose of description and should not be regarded as limiting. The use of "including" and "comprising" and variations thereof is meant to encompass the items listed thereafter and equivalents thereof as well as additional items and equivalents thereof. Further, enumeration may be used in the description of various embodiments. Unless otherwise expressly stated, the use of enumeration should not be construed as limiting the invention to any specific order or number of components. Nor should the use of enumeration be construed as excluding from the scope of the invention any additional steps or components that might be combined with or into the enumerated steps or components.

DESCRIPTION OF THE CURRENT EMBODIMENTS

Figure 1:
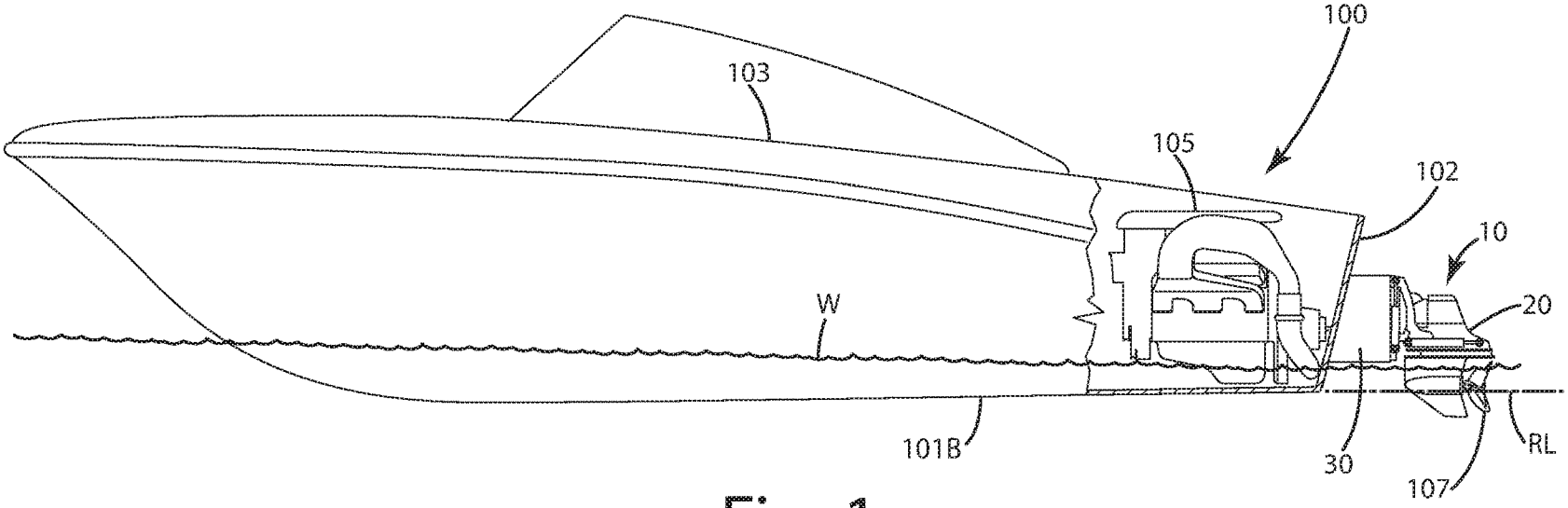
FIG. 1 is a side partial section view of a watercraft including an outdrive of the current embodiment with the outdrive in a neutral tilt mode and the drive unit in a raised mode.

A current embodiment of the watercraft outdrive is illustrated in FIGS. 1-9, and generally designated 10. As illustrated in FIGS. 1-6, the outdrive 10 is joined with a watercraft 100. Although shown as a high performance boat, the watercraft 100 with which the outdrive 10 is used can be any type of marine vessel, for example, a recreational boat, a racing boat, a pontoon boat, a fishing vessel, a tanker or other type of commercial vessel, a submarine, a personal watercraft, an amphibious vehicle, an underwater exploration vehicle, or virtually any other type of vessel that is propelled through or on water via a propeller.

The watercraft 100 includes a hull 101 having a stern 104 at which a transom 102 is located. The hull 101 also includes a bottom 101B. This bottom can coincide with or include a lowermost portion of the hull. The watercraft can include a reference line RL that extends rearward from the hull 101, and in particular, that extends from the lowermost portion of the transom 102 and/or bottom 101B, rearward from the boat. As used herein, this reference line RL is helpful in appreciating the spatial orientation of the propeller shaft 23, which includes its own longitudinal axis LA, relative to the lowermost portion of the transom and/or the bottom 101B of the watercraft.

Within the hull 101, an engine or motor 105 is disposed. With this configuration, the watercraft 100 is considered an inboard type of watercraft, where the engine is mounted inside the hull, rather than hanging off the back of the hull or otherwise disposed outside the hull. The engine is joined with an input shaft 106 that extends rearwardly from the engine and through a hole 102H in the transom 102. The hull hole 102H is sealed so that water cannot enter through the hole into the hull. A bearing (not shown) can be associated with the hull hole. The input shaft is rotated by the engine under force and generally is utilized to rotate the various components of the outdrive 10 and ultimately the propeller 107 as described below. Further, it will be understood that although referred to as an input shaft, this component can include multiple shafts or members connected to one another via different types of joints, such as universal joints. If there is more than one shaft connected to others, collectively, those shafts are still considered an input shaft.

The input shaft 106 extends rearward and is rotationally coupled to the components of the outdrive 10. Many components of the outdrive 10, as explained below, can be rotationally coupled to one another and directly or indirectly rotationally coupled to the input shaft 106. As used herein, rotatably coupled means that rotation of one element causes rotation of another element, regardless of whether the two elements are in direct contact with one another or have other elements therebetween, so that the two elements do not directly contact or engage one another during rotation.

The outdrive 10 can be mounted to the watercraft, and in particular, the transom 102. The outdrive 10 can include a drive unit 20 and a standoff box 30. The standoff box can interface directly with the transom 102 with a gasket or seal therebetween to prevent water from entering the input shaft hole 102H or other fastener holes used to connect the standoff box 30 to the transom. The standoff box can include the various components described herein to rotatably couple the input shaft 106 to a driveshaft SODS of the drive unit 20. The drive unit 20 can be movably joined with the standoff box 30 via a mounting bracket 11. The mounting bracket 11 can be oriented to enable the input shaft 106 to extend between portions of it or through it and directly to the outdrive unit 20. The mounting bracket can be outfitted with an armature or gimbal ring 12. This armature or gimbal ring can form a portion of a tilt assembly 40 as explained with further reference to FIGS. 3 and 4.

Figure 1A:
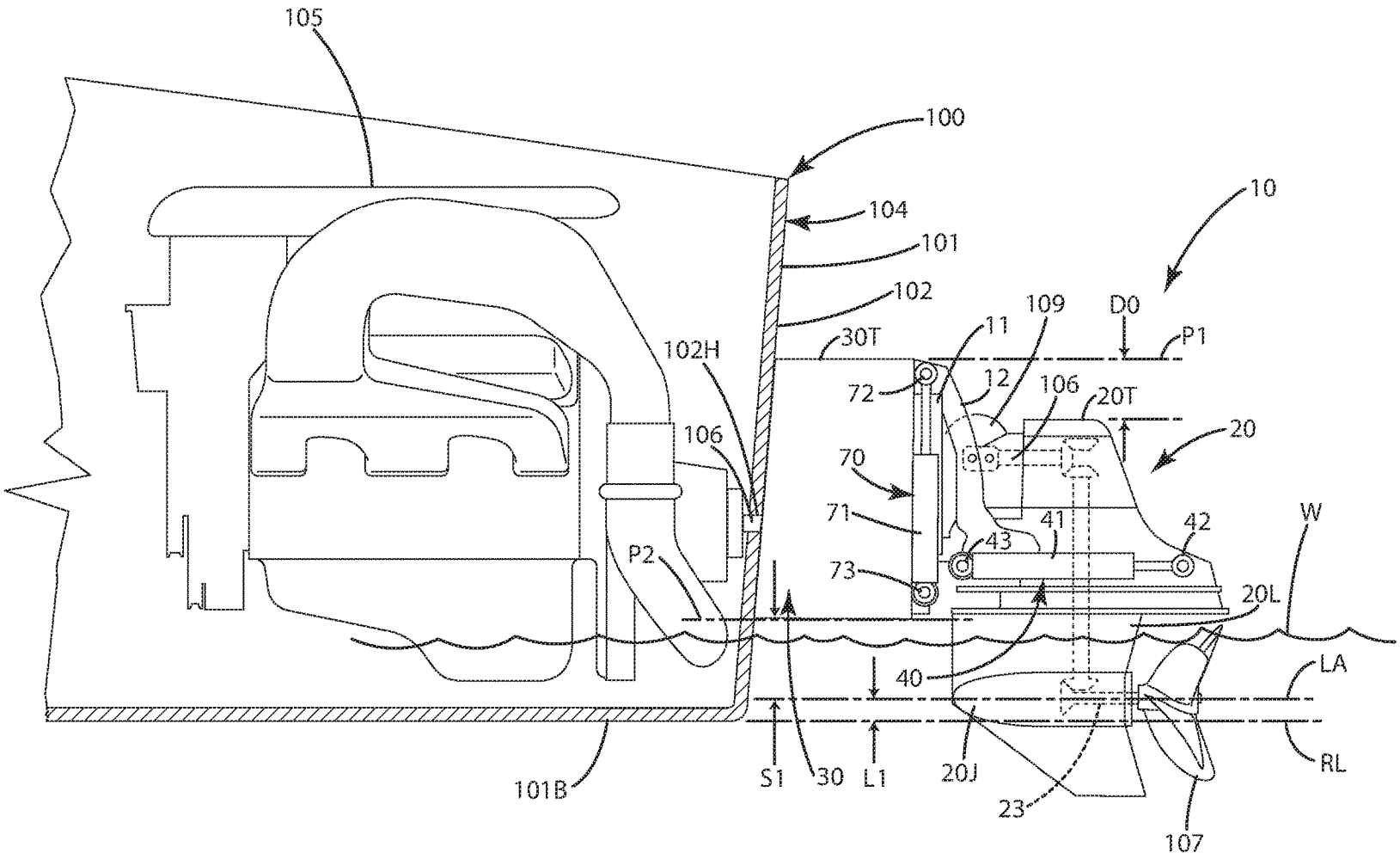
FIG. 1A is a close up section view of the watercraft and outdrive with the outdrive in a neutral tilt mode and the drive unit in a raised mode.

In particular, as shown in FIG. 1A, the tilt assembly 40 can include a tilt actuator 41 that can extend between the gimbal ring 12 and another portion of the outdrive 10. For example, the tilt actuator 41 can be joined pivotally with the gimbal ring 12 at one end 43, and at an opposite end 42, the tilt actuator can be joined with drive unit 20. The actuator 41 can be in the form of a hydraulic ram, pneumatic ram, or a set of gears. The tilt actuator 41 can be remotely operated by a user or operator of the watercraft 100 to extend and/or retract the actuator at its ends relative to one another. In so doing, the tilt assembly 40 operates to tilt the drive unit 20 relative to the watercraft.

Figure 3:
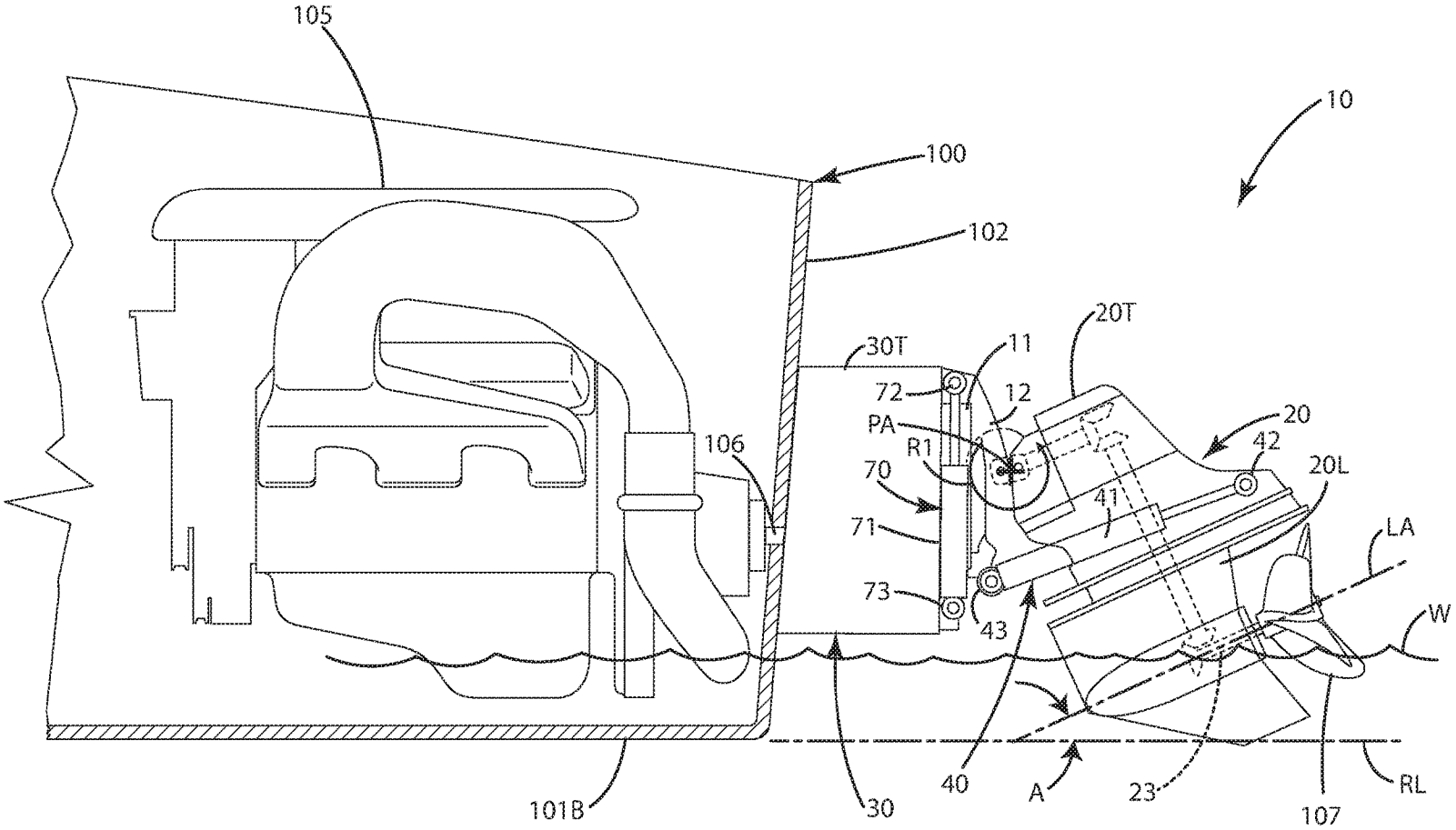
FIG. 3 is a side partial section view of a watercraft including an outdrive of the current embodiment, with the outdrive in an upward tilted mode and the drive unit in a raised mode.

In particular, the tilt assembly 40 can be operated to extend the tilt actuator 41 as shown in FIG. 3. In so doing, the actuator 41 effectively pushes and tilts the drive unit 20 upward. As the outdrive tilts, it pivots about one or more pivot axes PA, at which the drive unit 20 is attached to the gimbal ring 12 which is attached to the mounting bracket 11. When the outdrive tilts, for example, in direction R1 in FIG. 3, the orientation of the propeller shaft 23 and its longitudinal axis LA attains an angle A that is offset relative to the reference line RL. This upwardly offset angle can vary, depending on the operator's intended propulsion utilizing the propeller 107. In most cases, this upward tilt angle A can be an acute angle.

The tilt assembly 40 can be adjusted so that the tilt is neutral, as shown in FIG. 1A. This can mean that the propeller shaft 23 and its longitudinal axis LA are parallel to a portion of the hull of the watercraft. For example, the longitudinal axis LA can be parallel to the reference line RL and/or to the bottom 101B of the watercraft when the tilt is neutral. Of course, when the tilt assembly 40 is actuated to tilt the outdrive using the tilt actuator 41, pivoting in direction R1 about axis PA, the drive unit 20, tilts upward changing the orientation of the propeller shaft 23 and its longitudinal axis relative to the reference line RL to some angle A as shown in FIG. 3.

Figure 4:
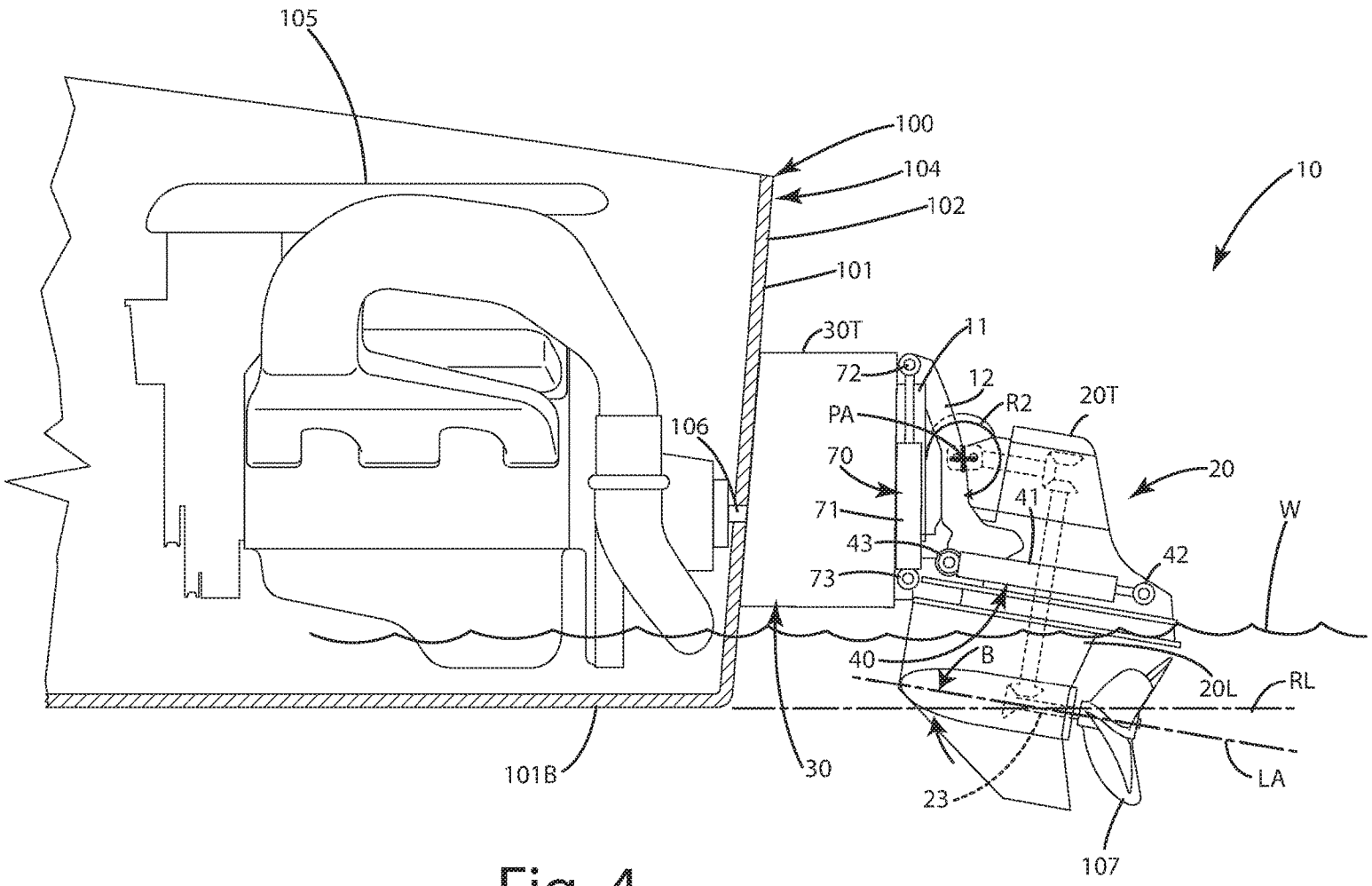
FIG. 4 is a side partial section view of a watercraft including an outdrive of the current embodiment, with the outdrive in a downward tilted mode and the drive unit in a raised mode.

As shown in FIG. 4, the tilt assembly 40 can also be adjusted so that the outdrive and propeller are tilted downward. For example, the tilt assembly 40 can actuate the tilt actuator 41 thereby bringing the ends 42 and 43 closer to one another. This actuator can be in the form of a ram or rod retracting into a hydraulic cylinder. This rotates the drive unit 20 about the pivot axis PA in direction R2. In so doing, the drive unit 20 can come closer to the bottom portion of the transom. Further, the propeller shaft 23 and its longitudinal axis LA tilts downward to an offset angle B relative to the reference line RL. This downwardly offset angle can vary, depending on the operator's intended propulsion utilizing the propeller 107. In most cases, this downward tilt angle B can be an acute angle.

In addition to the tilt assembly 40, the outdrive 10 of the current embodiment can include a drive assembly 50, a guide assembly 60 and a vertical adjustment assembly 70. All of these components can operate in concert to enable an operator to raise and lower the drive unit 20 relative to the standoff box, components thereof, and/or relative to the reference line RL. More particularly, the outdrive of the current embodiment is constructed so that the drive unit 20 can be operable in a raised mode as shown in FIG. 1A. There, the top 20T of the drive unit 20 is a vertical distance D0 from an upper surface of the standoff box 30. This distance D0 can be optionally 0, 1, 2, 3, 4, 5, 6 inches or increments thereof. Although illustrated with the top 20T below the upper surface of the standoff box, the top can in some cases and modes, be above the upper surface.

In this raised mode, the propeller shaft 23 and its longitudinal axis LA can be aligned in parallel to the reference line RL, particularly when the outdrive is in a neutral tilt position, as shown in FIG. 1A. In some cases, the longitudinal axis LA can be generally parallel to a plane within which the reference line RL lies in this raised mode. In this case, the longitudinal axis LA is offset 0 inches from the reference line RL. In other cases, the longitudinal axis LA can be disposed a preselected distance L1, for example 0, 1, 2, 3, 4, 5, 6 inches or increments thereof above the reference line RL. Optionally, the longitudinal axis LA can be disposed a small preselected distance L1, for example 0, 1, 2, 3, 4, 5, 6 inches or increments thereof below the reference line RL in the raised mode shown in FIG. 1A.

Optionally, when the outdrive is in the raised mode, the propeller shaft 23, and particularly its longitudinal axis LA, is disposed a first distance S1 (FIG. 1A) from the standoff box, and in particular, from the plane P2 in which the lowermost portion of the standoff box and/or lower wall 30B lays. This first distance S1 can extend, for example 0, 1, 2, 3, 4, 5, 6, 7, 8, 9, 10, 11, 12, 24 inches or increments thereof, below the plane P2.

Figure 2:
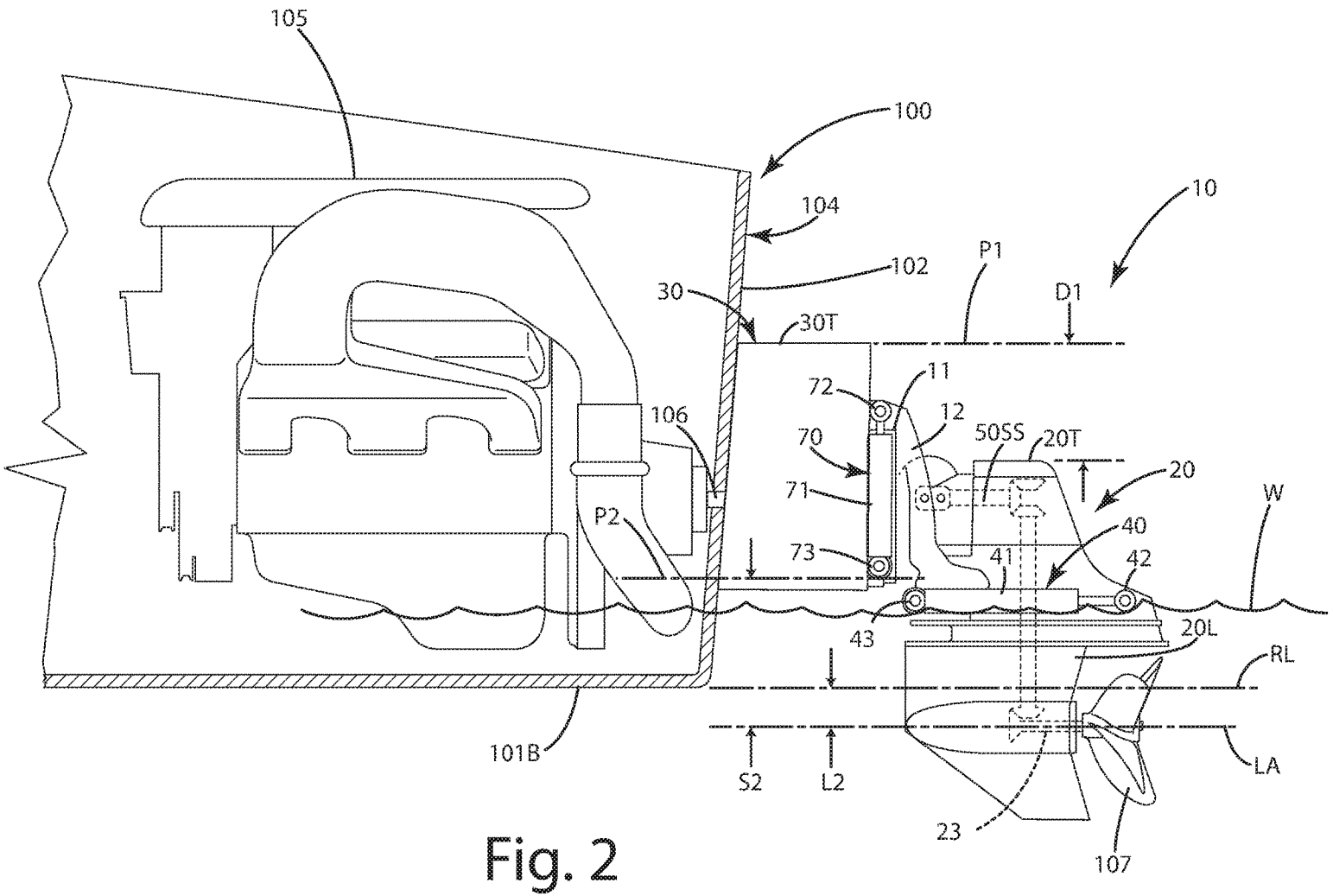
FIG. 2 is a side partial section view of the watercraft including the outdrive, with the outdrive in a neutral tilt mode and the drive unit in a lowered mode.

The drive unit 20 can be guided and urged with the vertical adjustment assembly 70 to a lowered mode as shown in FIG. 2. In this lowered mode, the top 20T of drive unit 20 moves downward relative to the upper wall 30T of the standoff box 30, and the plane P1 within which the uppermost portion of the standoff box and/or the upper wall lays, to a preselected distance D1. In effect, this distance D1 can be greater than D0. D1 can be optionally 0, 1, 2, 3, 4, 5, 6, 7, 8, 9, 10, 11, 12, 24 inches or increments thereof.

In this lowered mode, the propeller shaft 23 and its longitudinal axis LA can be aligned in parallel to the reference line RL, particularly when the outdrive is in a neutral tilt position, as shown in FIG. 2. In some cases, the longitudinal axis LA can be parallel to a plane within which the reference line RL lies in this lowered mode. In other cases, the longitudinal axis LA can be disposed a preselected distance L2, for example 0, 1, 2, 3, 4, 5, 6 inches or increments thereof below the reference line RL. Optionally, the longitudinal axis LA can be disposed a small preselected distance L2, for example 0, 1, 2, 3, 4, 5, 6 inches or increments thereof above the reference line RL in the raised mode shown in FIG. 1A.

Optionally, when the outdrive is in the lowered mode, the propeller shaft 23, and particularly its longitudinal axis LA, is disposed a second distance S2 (FIG. 2) from the standoff box, and in particular, from the plane P2 in which the lowermost portion of the standoff box and/or lower wall 30B lays. This second distance S2 can be greater than the first distance S1, for example 1, 2, 3, 4, 5, 6 inches or increments thereof greater than the first distance S1.

The drive unit 20 of the outdrive 10 is movable from the raised mode to the lowered mode while the watercraft 100 is moving through a body of water W and while the propeller shaft 23 and the propeller 107 are spinning and producing thrust to propel the boat in a direction. The drive unit 20 is movable vertically upward and downward (as opposed to being tilted upward or tilted downward) while the watercraft is moving through a body of water and while the propeller shaft 23 and the propeller 107 are spinning and producing thrust. Further, the spatial offset of the longitudinal axis LA from the distance L1 to a second, different distance L2 (in transitioning from the raised mode to the lowered mode) can all occur while the watercraft is under power and the propeller is spinning. Certain components of the drive assembly 50, for example the driveshaft, secondary shaft, transfer block, transfer gear or other components as described below also can move relative to the standoff box upper wall 30T, and the plane P1 in which it extends, during the transition from the raised mode to the lowered mode and vice versa, all while the propeller is spinning and the watercraft is moving and/or under power.

During the movement of the drive unit 20 relative to the standoff box 30, for example, as shown in FIGS. 1A and 2, the spacing between the longitudinal axis LA of the propeller shaft 23 changes relative to the reference line RL. Again, in the raised mode the spacing between the reference line RL and the longitudinal axis LA of the propeller shaft 23 can be a distance L1 (FIG. 1A). When the drive unit 20 is vertically lowered relative to the standoff box 30, this vertical spacing changes so that the longitudinal axis LA of the propeller shaft 23 is spaced a second, optionally greater distance, L2 (FIG. 2) from the reference line RL. It will be noted that during this transitional movement and alteration of the spacing of the longitudinal axis LA of shaft 23 relative to the reference line RL, the longitudinal axis LA can maintain a constant angular orientation relative to the reference line RL (assuming that the tilt assembly is not simultaneously actuated during the raising and lowering).

Accordingly, assuming the tilt is neutral as shown in FIGS. 1 and 1A, when the drive unit 20 is moved to the lowered mode shown in FIG. 2, the longitudinal axis LA of the propeller shaft 23 remains in a parallel configuration relative to the reference line RL. If the outdrive is in an upward tilted mode as shown in FIG. 3, when lowering from a raised mode to a lower mode of the drive unit 20 occurs, the longitudinal axis LA of the propeller shaft 23 can be maintained at the offset angle A relative to the reference line RL throughout the vertical spacing adjustment or downward movement. If the outdrive 10 is in a downward tilted mode, as shown in FIG. 4, when lowering from a raised mode to it lowered mode of the drive unit occurs, the longitudinal axis LA of the propeller shaft 23 can be maintained at the offset angle B relative to the reference line RL throughout the vertical spacing adjustment or downward movement. Likewise, in the first operation, where the drive unit 20 is moved from the lowered mode to the raised mode, the longitudinal axis LA can maintain its angular orientation relative to the reference line RL throughout the movement.

Figure 5:
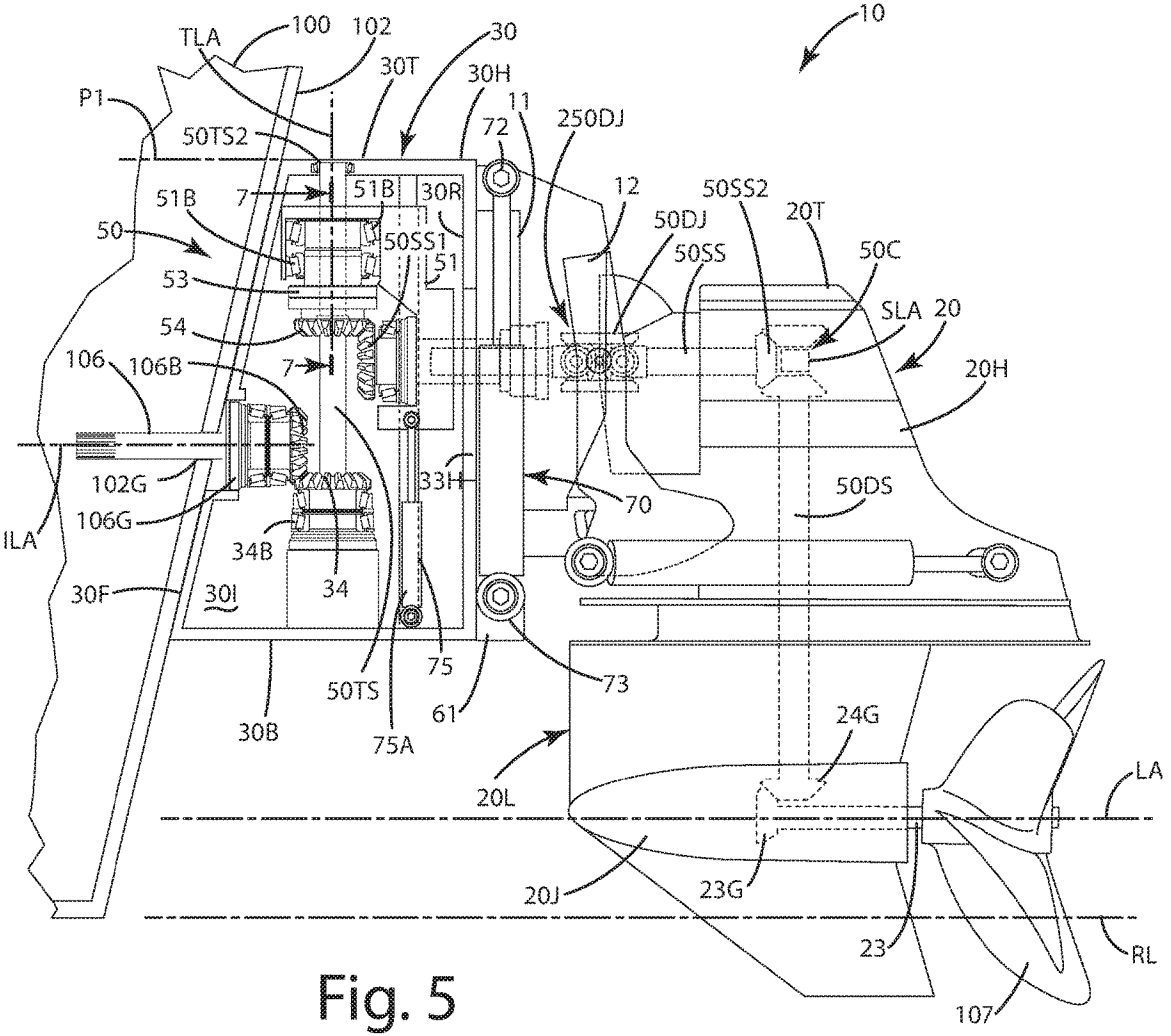
FIG. 5 is a side partial section view of a standoff box and drive assembly of the outdrive with the drive unit in a raised mode.
Figure 6:
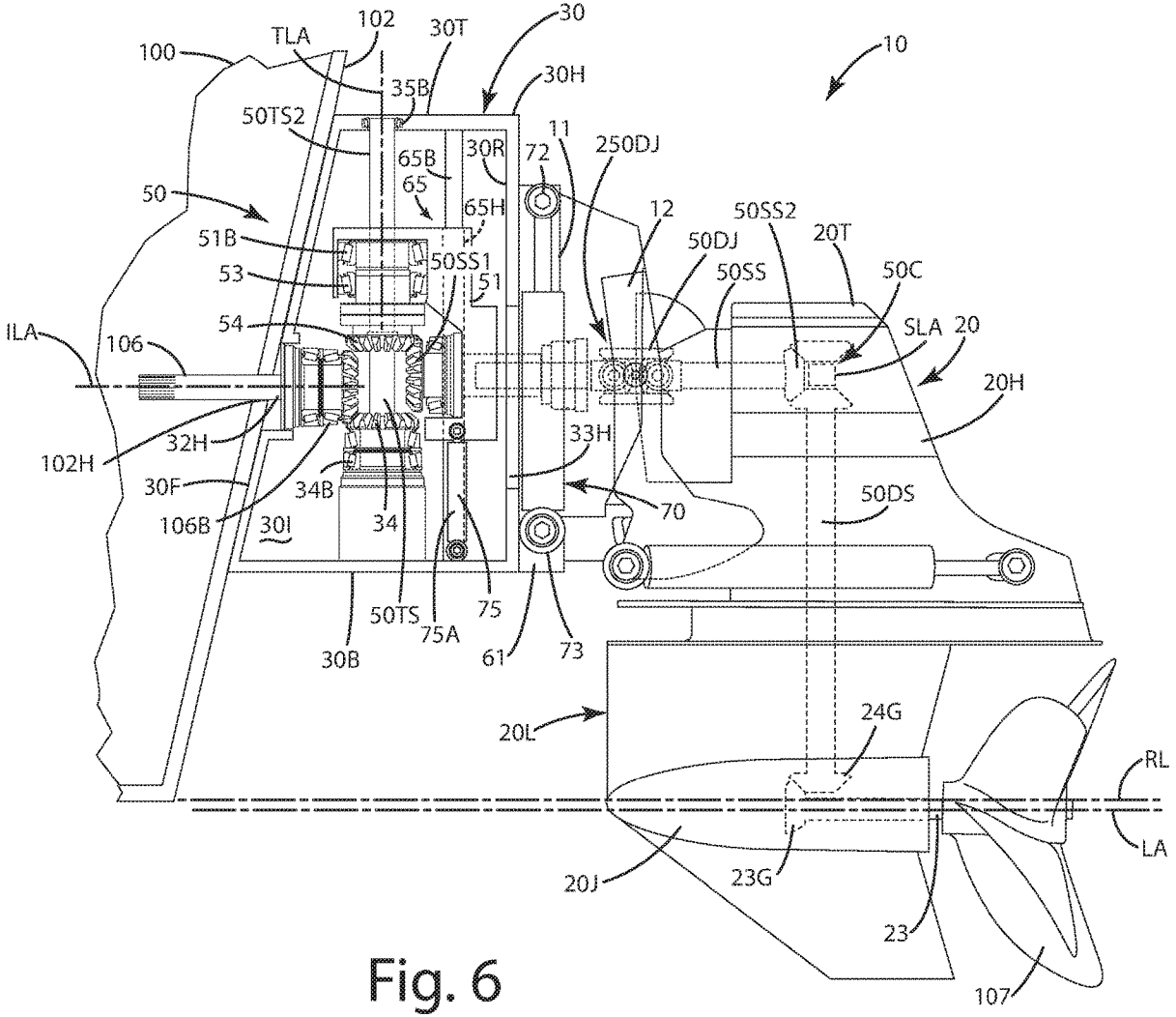
FIG. 6 is a side partial section view of the drive assembly of the outdrive with the drive unit in a lowered mode.

The various components of the outdrive 10, for example the various housings, the drive unit 20, standoff box 30, the guide assembly 60, the vertical adjustment assembly 70 and the drive assembly 50 will now be described in more detail. As shown in the views of FIGS. 5 and 6, the outdrive 10 can include a drive unit 20. The drive unit 20 can include a drive unit housing 20H within which are some components of the drive assembly. The drive unit can be constructed in upper and lower parts, depending on the application. A secondary shaft 50SS can extend out from the standoff box 30 and into the housing 20H, and can interface with the driveshaft SODS as explained further below. The drive unit 20 can include an upper or top surface 20T which can generally form the uppermost portion of the housing. This top surface can be planar and/or rounded, and can pass within a plane associated with an uppermost extent of the housing 20H and/or the drive unit 20 in general.

The drive unit 20 can include a lower portion 20L. This lower portion can include a bullet or torpedo 20J that houses the propeller shaft 23 and associated gear 23G, which interfaces with the gear 24G that is connected to the driveshaft SODS of the drive assembly 50. The drive unit 20 can also include the propeller 107 which is fixedly and non-rotatably joined with the propeller shaft 23.

With reference to FIGS. 5 and 6, the components and operation of the guide assembly 60 and the vertical adjustment assembly 70 will be described in further detail. To begin, the vertical adjustment assembly 70 is the component of the outdrive that moves the drive unit vertically, and generally relative to the standoff box 30. Depending on the particular application, the various components of the vertical adjustment assembly can be joined with the mounting bracket 11 and the standoff box 30 respectively. Further, the vertical adjustment assembly can be operated remotely, for example, from a cabin, a helm and/or at an operator station via electrical, manual, hydraulic, pneumatic or other controls to provide the desired raising and/or lowering of the outdrive unit 20 relative to the standoff box 30.

Figure 8:
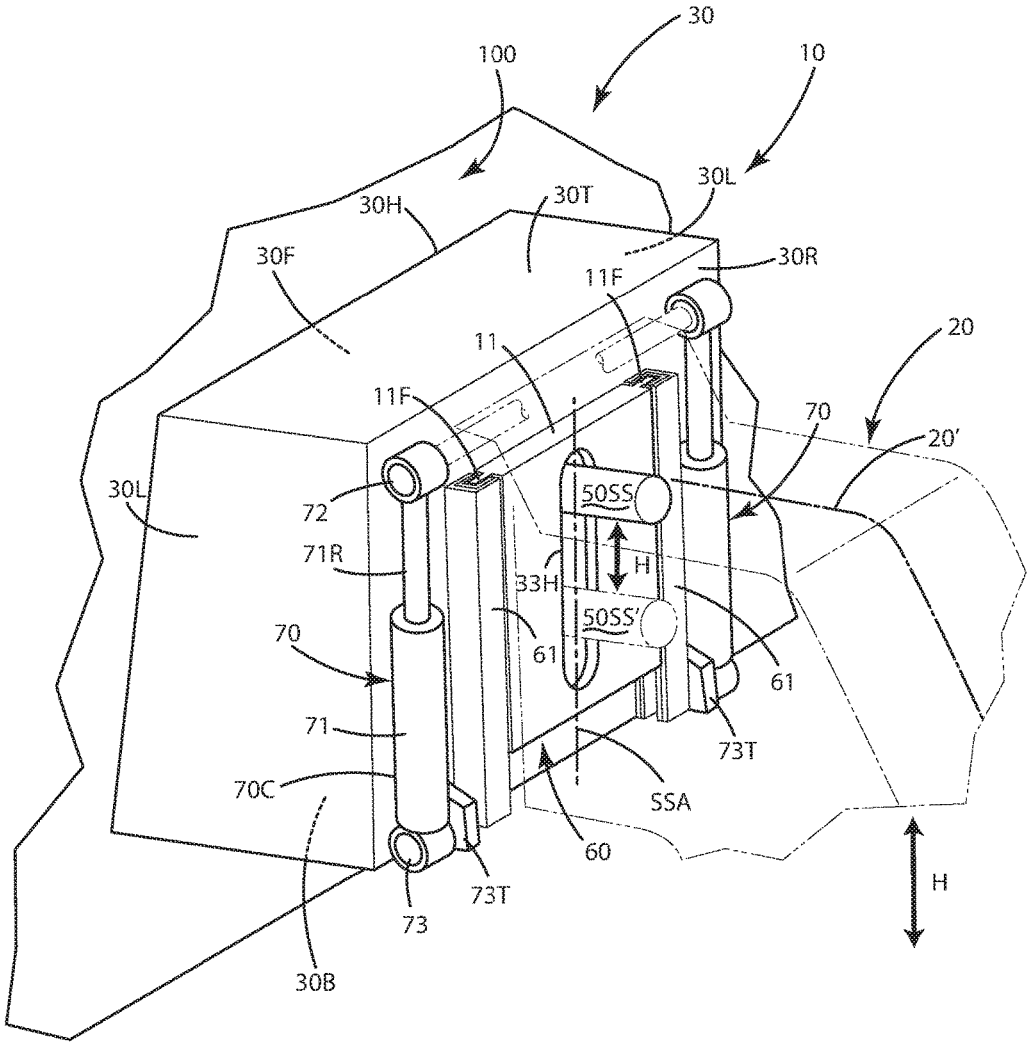
FIG. 8 is a rear view of the standoff box illustrating movement of the secondary shaft upon lowering of the drive unit.

As shown in FIGS. 5, 6 and 8, the vertical adjustment assembly 70 can include first and second actuators 71. As mentioned above, these actuators 71 can be in the form of hydraulic, pneumatic or other types of cylinders with rams 71R that extend and retract relative to a main body or cylinder 70C. The amount of force with which the rams 71R extend and retract can vary depending on the particular application and the watercraft. The actuators 71 can be disposed symmetrically across from one another on opposite sides of the standoff box 30. This can provide a balanced application of force to raise and lower the drive unit 20 relative to the standoff box 30. Optionally, the left and right actuators 71 can be in a common fluid or hydraulic circuit so that the actuators simultaneously, consistently and evenly engage the mounting plate 11 to which the upper ends 72 of the rams 71R are attached to move it and the drive unit 20, along with all of its components, in an even and level manner upward and downward to and from the various modes. Lower ends 73 can be joined directly to the standoff box 30 via tabs 73T extending from the rearward wall 30R of the standoff box 30.

The guide assembly 60 can operate in concert with the vertical adjustment assembly 70 to provide a smooth, guided, and even consistent raising and lowering of the outdrive relative to the standoff box and vice versa. As shown in FIGS. 5, 6 and 8, the guide assembly 60 can include one or more guide channels 61, optionally attached to the standoff box, and in particular, the rear wall 30R thereof. These guide channels can be C- or U-shaped channels configured to constrain flanges and/or edges 11F of the mounting bracket 11. In effect, the guide channels can guide the flanges 11F as they move upward and downward within the channels. Because the drive unit 20 is attached to the gimbal ring 12 which is attached to the mounting bracket 11, the drive unit 20 also moves vertically upward and/or downward when the flanges move upward or downward within the respective channels. Of course, other types of guides, such as rods, bars or the like can be substituted for the flanges/channels between the standoff box and the drive unit to provide a guiding interface so that the drive unit can move consistently and evenly in a non-binding manner relative to the standoff box, when moving from the raised mode to the lowered mode and vice versa.

Optionally, the precise location of the elements and components of the drive assembly and vertical adjustment assembly can be moved relative to one another about the drive unit 20 and the standoff box 30. Further, fewer or less of each respective component can be included in the outdrive 10, depending on the particular application. In some cases, it may be satisfactory to include only a single vertical adjustment assembly and associated actuator and a single system of guide channels and/or rods. In others, additional guide assembly components and vertical adjustment assembly components can be helpful.

As mentioned above, the outdrive 10 includes a drive assembly 50. This drive assembly is configured to enable the drive unit 20 to move upward and downward, vertically relative to the standoff box 30, while maintaining the input shaft 106 rotatably coupled to the propeller shaft 23. Accordingly, the drive unit 20 can be moved to a lowered mode and back to a raised mode, all while the drive assembly conveys rotational force to the propeller 107, and all while the boat is under power, moving through water.

Many components of the drive assembly 50 are disposed in or otherwise joined with the standoff box 30. The standoff box 30 can be in the form of an enclosed box or housing 30H defining an interior 301. The box or housing can include an upper top wall 30T as described above and an opposing lower or bottom wall 30B. The standoff box 30 also can include a rearward wall 30R and opposing forward or transom facing wall 30F. The forward transom facing wall 30F can be bolted directly to the transom 102 such that the standoff base is stationary and/or fixed immovably to the transom 102 or the hull. Seals and/or gaskets can be disposed between the transom and the standoff box, as well as between the mounting bracket and the standoff box to prevent leakage of water into the hole and/or box. The forward and rearward walls can be non-parallel to one another, as shown in FIGS. 1-6. There, the rearward wall is at a right angle to the bottom wall, while the front wall is at an acute angle relative to the bottom wall when positioned on the interior. Optionally, the forward and rearward walls can be offset at any angle depending on the application.

The forward transom facing wall 30F can define an input shaft hole 32H adapted to receive therethrough the input shaft 106. The input shaft hole 32H can be aligned with the hull hole 102H. The rearward wall 30R can define a secondary shaft hole 33H adapted to receive therethrough a secondary shaft 50SS. The secondary shaft hole 33H as illustrated in FIG. 8, can be in the form of an elongated slot which can be substantially vertically oriented, and/or oriented at an angle relative to vertical in some applications. This elongated slot can include a secondary shaft hole axis SSA, which is generally parallel to the longest and/or largest dimension of the hole 33H. This axis SSA can be vertical and optionally parallel to the lateral sidewalls 30L of the standoff box 30. As explained further below, the secondary shaft 50SS, extending from the standoff box to the drive unit, can be movable nearly along and/or parallel to the secondary shaft hole axis SSA so that the secondary shaft moves toward and/or away from the bottom wall 30B of the housing 30H as the secondary shaft rotates and is rotatably coupled to the input shaft. As shown in FIG. 8, the secondary shaft 50SS is in an upward position relative to the hole 33H when the drive unit 20 is in the raised mode. As shown in broken lines, the secondary shaft 50SS' moves to a lowered position in the hole when the drive unit 20' is in the lowered mode.

With reference to FIGS. 1A and 5-8, the drive assembly 50 includes multiple shafts and gears that are rotationally coupled to one another. To begin, in FIG. 5, the drive assembly 50 and its components are rotated via the input shaft 106 that extends through the transom 102 of the watercraft 100 and ultimately to the engine 105 within the hull of the watercraft. In many applications, the input shaft 106 is constantly spinning, as soon as the engine is started. The input shaft 106 can be configured in a substantially horizontal orientation, and can extend through the transom 102 of the boat 100, through the front or transom facing wall 30F of the standoff box 30 and into the interior 301 of the standoff box 30. The input shaft can be rotatably mounted in a bearing element 106G that is itself mounted and/or associated with the front wall 30F of the standoff box 30.

Optionally, the input shaft can include input shaft longitudinal axis ILA. This input shaft longitudinal axis can be parallel to enter slightly offset relative to the reference line RL. The input shaft longitudinal axis can be substantially perpendicular to a transfer shaft longitudinal axis TLA associated with the transfer shaft SOTS. The input shaft longitudinal axis can be substantially parallel to the secondary shaft longitudinal axis SLA. Likewise, the secondary shaft longitudinal axis SLA can be perpendicular to the transfer shaft longitudinal axis TLA of the transfer shaft. Of course, the various shafts can be slightly angled relative to one another, and not perfectly perpendicular and/or parallel to one another, depending on the application. Further, where universal joints or other articulating joints are included along a particular shaft, certain shaft portions may or may not be parallel and/or perpendicular to other portions of other shafts.

The input shaft 106 can include a bevel gear 106B. This bevel gear 106B can be disposed adjacent and can interface with a base transfer shaft gear 34. This base transfer shaft gear 34 can be fixed non-rotationally to the transfer shaft SOTS. For example, the shaft SOTS can be keyed, and the gear 34 can include a keyhole. Alternatively, one of the shaft or gear can be splined and the other can include a corresponding spline hole to prevent rotational movement between the transfer shaft and the base transfer shaft gear.

The drive assembly 50 can include the transfer shaft SOTS shown in FIGS. 5 and 6. This transfer shaft SOTS is disposed in the interior 301 of the standoff box 30. Transfer shaft can include a first end 50TS1 and a second opposing end 50TS2. Each of these ends can be rotationally mounted relative to the standoff box 30 and/or components thereof. For example, the upper or second end 50TS2 can be mounted via bearings 35B to the upper wall 30T of the standoff box 30. The lower or first end 50TS1 can be mounted and joined with the first transfer shaft gear 34. The gear and/or lower portion or end 50TS1 of the transfer shaft can be mounted to a bearing 34B that is joined with the bottom 30B of the standoff box. In this manner, the transfer shaft SOTS can be rotatably mounted in the standoff box, and can rotate about a transfer shaft axis TLA in the standoff box 30.

Optionally, the first transfer shaft gear 34, associated with the first end of the transfer shaft, is located distal from the transfer gear 54. The first transfer shaft gear 34 can be non-rotatably fixed to the transfer shaft. In some cases, the transfer shaft gear 34 can in some applications be immovable linearly along the transfer shaft longitudinal axis TLA. Further optionally this gear 34 is immovable toward and/or away from the bottom wall 30B during operation of the outdrive. The transfer gear 54, however, can be movable toward and away from the first end of the transfer shaft 50TS1, and/or the first transfer shaft gear 34 linearly, while the transfer gear and the first transfer shaft gear rotate in unison with the transfer shaft SOTS.

As shown in FIGS. 5 and 6, the drive assembly 50 can include a transfer block 51. Transfer block 51 can be non-rotatably mounted within the interior 301 of the standoff box or fixed mounted relative to any other components of the standoff box. For example, the transfer block does not rotate relative to any of the walls of the housing 30H. The transfer block, however can be movable linearly along the transfer shaft SOTS. For example, the transfer block 51 can move along the transfer shaft SOTS from the raised mode shown in FIG. 5 to the lowered mode shown in FIG. 6, moving from end to end of the transfer shaft. In this manner, transfer block 51 moves away from the upper wall 30T and toward the lower wall 30B of the housing 30H, when the drive unit 20 is moved from a raised mode shown in FIG. 5 to the lowered mode shown in FIG. 6. Optionally, the transfer block 51 moves downward within the interior when the drive unit moves from the raised mode to the lowered mode. Further optionally, the transfer block moves upward within the interior when the drive unit moves from the lowered mode to the raised mode.

The transfer block 51 can be configured so that it is movable linearly along the transfer shaft, toward and away from the bottom wall and/or the top wall. Optionally, the transfer shaft rotates relative to the transfer block, but not vice versa.

A transfer gear 54 can be rotatably mounted to the transfer block 51. The transfer gear can be non-rotatably fixed to the transfer shaft SOTS so that the transfer gear rotates in unison with the transfer shaft. The transfer gear 54 can be movable linearly along the transfer shaft longitudinal axis TLA and generally the transfer shaft itself. Likewise, the transfer block also can be linearly movable along these components. The transfer gear 54 can be directly or indirectly coupled to the transfer block 51 via a set of bearings 51B. These bearings can assist in providing even and consistent rotation between the transfer gear 54 and the transfer block 51, and optionally between the transfer shaft SOTS and the transfer block 51. The bearings can be any type of bearing system, such as roller bearings, and the like. Of course, in certain applications, the bearings can be eliminated and a decreased friction surface can be disposed between the transfer block and the transfer gear 54 and/or transfer shaft.

Optionally, the transfer block 51 can be outfitted with a guide assembly 65, shown in FIG. 6. This guide assembly can supplement and/or can replace the guide assembly 60 as described above. This guide assembly 65 can include one or more rods or bars 65B that extend between the upper wall 30T and the lower wall 30B of the standoff box. The transfer block 51 can define bores 65H extending therethrough. The rods or bars 65B can be disposed in these bores 65H. Optionally, bearing elements can be disposed between the outside of the rods in the inside of the bores. When the transfer block 51 moves up or down, the transfer block is guided by the interaction of the rods with the bores to maintain consistent and even movement of the transfer block upward and downward.

Further optionally, the transfer block 51 can be outfitted with a vertical adjustment assembly 75. This vertical adjustment assembly can supplement and/or can replace the vertical adjustment assembly 70 as described above. This vertical adjustment assembly can include an actuator 75A, which can be in the form of a hydraulic actuator, a pneumatic actuator and/or a set of gears. This actuator 75A can be joined with the transfer block 51 and one or more of the walls of the housing 30H. As illustrated, the actuator 75A is attached to a lower portion of the transfer block 51, as well as the bottom wall 30B. When the actuator extends, as shown in FIG. 5, it can raise the transfer block and can assist in raising the drive unit 20. When the actuator retracts, as shown in FIG. 6, it can lower the transfer block 51 and can assist in lowering the drive unit 20. Of course, in some cases, the actuator can be duplicated and/or eliminated, assuming the vertical adjustment assembly 70 is sufficient to raise and lower the drive unit 20 relative to the standoff box.

As shown in FIGS. 5 and 6, the transfer gear 54 interfaces with and is rotatably coupled to the secondary shaft 50SS. The secondary shaft 50SS extends from the interior 301 of the standoff box, out through the secondary shaft hole 33H and into a housing 20H of the drive unit 20. The secondary shaft can be associated with and/or non-rotatably joined with a first secondary shaft gear 50SS1. The transfer gear 54, as mentioned above, rotatably engages the first secondary shaft gear 50SS1. Accordingly, when the transfer gear 54 rotates, it rotates the first secondary shaft gear associated with a first end of the secondary shaft 50SS. In turn, the secondary shaft 50SS also turns. As a result, due to the rotatable coupling of the transfer shaft 50SS to the driveshaft SODS, this rotates the driveshaft SODS and ultimately the propeller 107 as described further below.

More particularly, when it rotates, the secondary shaft 50SS engages a clutch 50C disposed in the housing of the drive unit 20. This clutch 50C can be a cone clutch, and can be operated with a gear selecting fork (not shown). Via the clutch and the gear selector, a user can remotely, from elsewhere on the watercraft, for example, at a helm, adjacent a steering wheel, or at a control center of the watercraft inside or above the hull, select neutral, forward, or rearward propulsion via the outdrive. Exemplary cone clutches and gear selectors are disclosed in U.S. Pat. No. 6,960,107 to Schaub and U.S. Pat. No. 6,523,655 to Behara, both of which are incorporated by reference herein in their entirety. Of course, other types of clutches and gear selectors can be utilized. In some cases, the clutch 50C can be absent, and/or located in a different portion of the outdrive.

The clutch 50C, as illustrated is rotatably coupled to the driveshaft SODS. As mentioned above, the driveshaft is further rotatably coupled to the propeller shaft 23 which itself is non-rotatably joined with the propeller 107. In operation, the input shaft 106 rotates the transfer shaft SOTS, which via the articulating connectors rotates the secondary shaft 50SS. The secondary shaft, via a second secondary shaft gear 50SS2 associated with a second end of the secondary shaft, engages two gears on the shaft SODS, which can be rotatable relative to the shaft, with bearings between the components. The two gears engage the clutch 50C (but not at the same time) when the clutch 50C is moved up or down. The secondary shaft gear 50SS2 thereby transfers rotational force to the driveshaft SODS through the gears and the clutch arrangement. Accordingly, upon rotation of the driveshaft SODS, it in turn rotates the gears 24G and 23G, the propeller shaft 23 and the propeller 107. This rotation of all the elements of the drive assembly 50 occurs while the drive assembly is under power and rotating via input from the input shaft 106. The rotation of all these components can occur equally and similarly in both the raised mode and lowered mode of the lower drive unit.

Optionally, as used herein, the term driveshaft can refer to a unitary driveshaft of a single construction, as well as a driveshaft combined with a connector shaft to form a longer, overall shaft. As mentioned above, the driveshaft extends downwardly in the drive unit 20 and is rotationally coupled to the propeller shaft 23 via one or more gears 24G and 23G. Upon rotation of the driveshaft, the propeller shaft 23 and propeller rotate as well. Further optionally, as shown in FIG. 5, the secondary shaft 50SS can include a double universal joint 50DJ, which is described in more detail in the embodiments below and with reference to FIG. 12.

An aspect of the drive assembly 50 is that the transfer gear 54 can move linearly, up and down relative to transfer shaft SOTS while still remaining rotatably coupled to the propeller shaft 23. Put another way, the driveshaft can continue to be rotatably coupled to the input shaft 106 and rotate, all while the drive unit 20 is in the raised or lowered mode and/or moving somewhere in between, and/or all while the transfer gear 54 (and any associated transfer block) moves linearly up and down in the standoff box housing 30H. The driveshaft continues to rotate the propeller 107 while the watercraft is under power and the input shaft 106 is rotating the various components of the drive assembly 50, in either the raised mode, the lowered mode, and during the transition from the raised mode to the lowered mode and vice versa. At all times, the driveshaft can continue to rotate the propeller regardless of the transitioning between the raised and/or lowered modes or vice versa. To do so, the drive unit 20 is vertically movable upward and downward relative to the standoff box as described herein.

Figure 7:
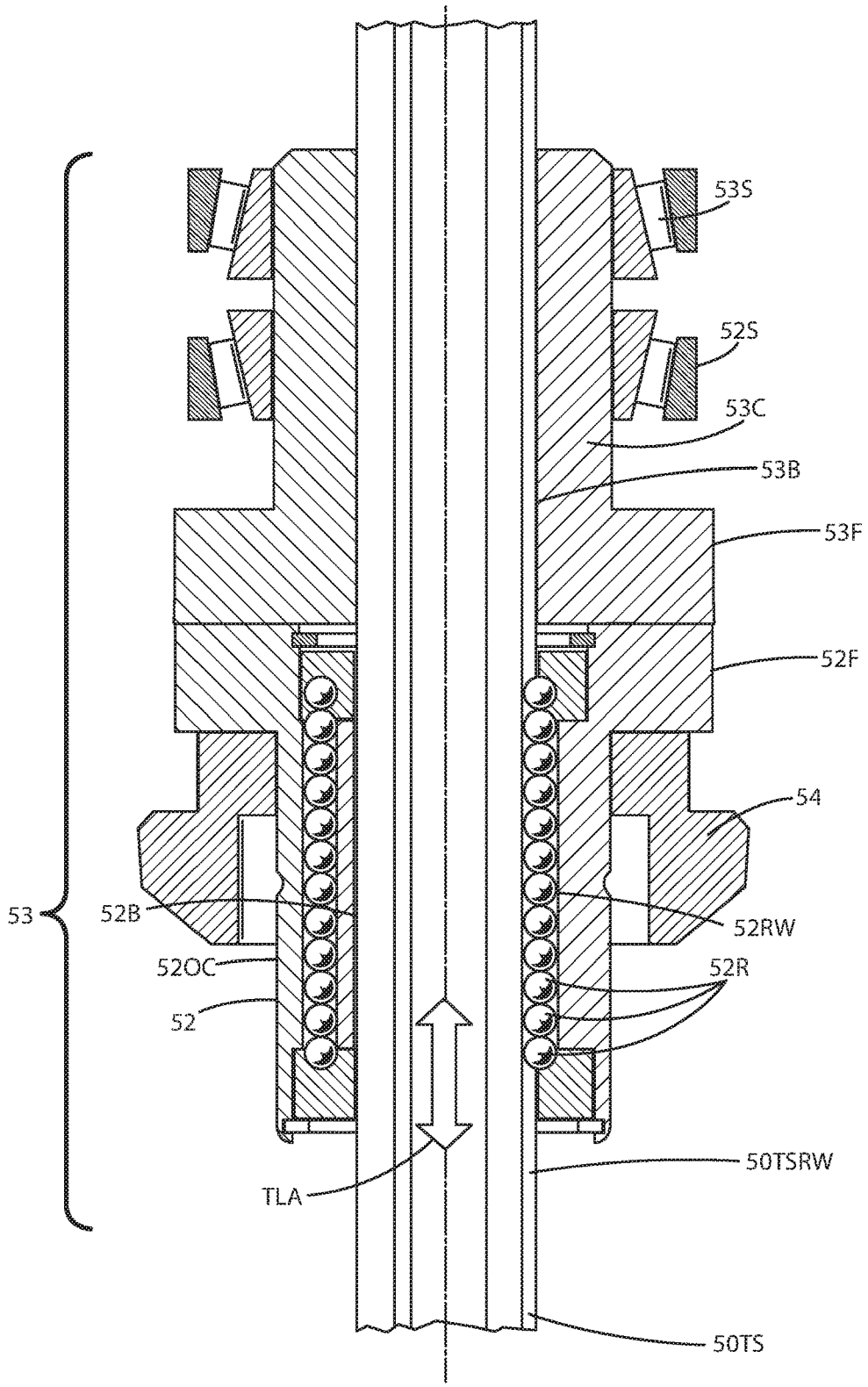
FIG. 7 is a section view of a ball spline illustrating bearing elements therein interacting with a driveshaft so that the driveshaft can move linearly through the ball spline but is non-rotatable relative to the ball spline, taken along line 7-7 of FIG. 5.

The outdrive 10 can include a ball spline 52 that is joined with the transfer gear 54 in a fixed and non-rotatable manner. As shown in FIGS. 5-7, the ball spline 52 can be joined with the transfer gear 54. To do so, the ball spline 52 can include an outer cylinder 520C. The outer cylinder 520C can be joined with a flange 52F, which can be fastened, welded or otherwise joined non-rotatably to another flange 53F. This other flange 53F can be joined to a bearing cylinder 53C. The bearing cylinder 53C can be joined with bearing sets 52S and 53S. The bearing sets can be rotatably mounted in a corresponding bore 51B of the transfer block 51. The bearing sets 52S and 53S can enable the entire ball spline gear unit 53, which includes the ball spline 52, along with the gear 54, to rotate relative to the transfer block freely. In general, all of the components of the ball spline gear unit 53 can be non-rotatably fixed the joined with one another. Accordingly, the transfer gear 54 rotates in unison with the ball spline 52, and both rotate relative to the transfer block 51 and the standoff box 30 in general.

Referring to FIG. 7, the ball spline 52 can be any suitable type of ball spline. As illustrated, the ball spline 52 includes the outer cylinder 520C defining an internal bore 52B. This internal bore 52B can be coextensive with the internal bore 53B of the bearing cylinder 53C so that the ball spline unit can move linearly along the transfer shaft SOTS and its transfer shaft longitudinal axis TLA.

The ball spline 52 can define a first bearing raceway 52RW that is in communication with the internal bore, that is, objects within the first bearing raceway 52RW can move into and out from the internal bore 52B or portions thereof. The ball spline also includes multiple bearing elements 52R, which as illustrated are in the forms of balls, such as ball bearings that are spherical in shape. These balls 52R are disposed in the first bearing raceway 52RW. The transfer shaft SOTS is likewise configured define a groove 50TSRW. This groove effectively forms a second raceway. The second raceway is in communication with the first raceway 52RW. Accordingly the balls or bearings 52R can move and/or roll to and from and/or in both from the first raceway and the second raceway and vice versa depending on relative movement of the ball spline and transfer gear 54 relative to the transfer shaft SOTS.

Via the interaction of the balls with the first raceway in outer cylinder 52, as well as the second raceway defined by the transfer shaft, the transfer gear 54 can move linearly along the transfer shaft, up-and-down, when the drive unit 20 is moved from the raised mode to the lowered mode and vice versa. Due to the ball spline's interaction with the shaft however, that transfer gear 54 is rotationally fixed to the shaft, that is, the shaft does not rotate relative to the ball spline and the transfer gear 54 does not rotate relative to the shaft. Accordingly, the transfer gear 54 and the transfer shaft rotate in unison, in both the raised mode and the lowered mode and all positions therebetween.

As shown in FIGS. 5 and 6, the drive assembly is structured to provide linear movement of the transfer gear 54, along the transfer shaft, as the transfer gear 54 engages the first secondary shaft gear and corresponding secondary shaft to provide rotational force sufficient to rotate the driveshaft and associated propeller shaft. While the drive assembly and outdrive are under power, and while the drive unit 20 is being moved from a raised mode shown in FIG. 5 to a lowered mode shown in FIG. 6. In effect, the propeller shaft effectively remains rotatably coupled to the input shaft through the transfer shaft, transfer gear 54, ball spline, and transfer gear 54 of the drive assembly 50.

Figure 9:
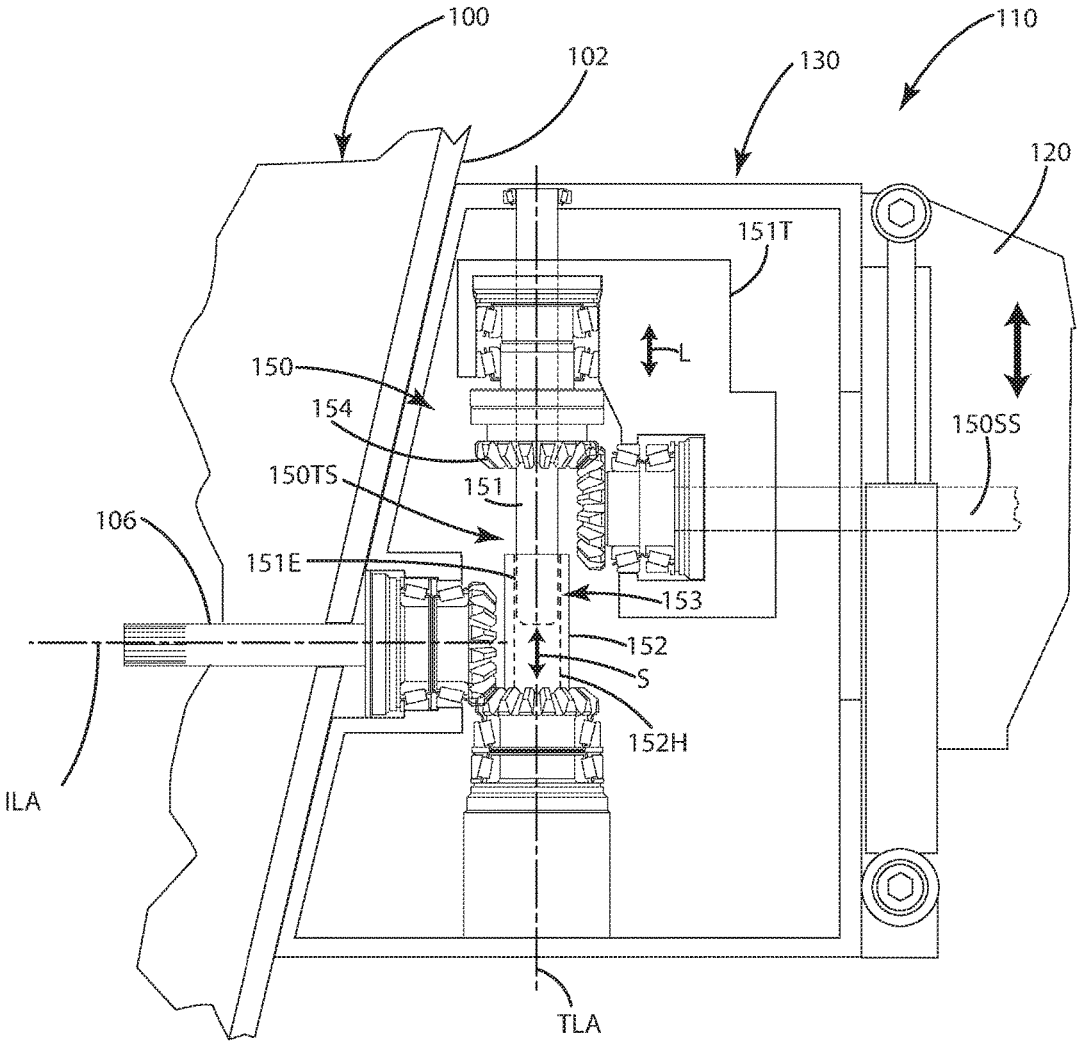
FIG. 9 is a side view of a first alternative embodiment of the standoff box with a transfer shaft having portions joined via a spline connection.

A first alternative embodiment of the outdrive is shown in FIG. 9 and generally designated 110. The structure, function and operation of this embodiment is similar to the embodiment described above with several exceptions. For example, this embodiment includes a drive unit 120 joined with a transom 102 of a boat 100 via a standoff box 130. The standoff box 130 includes a portion of a drive assembly 150, virtually identical to that described above, and the drive unit 120 includes the remainder of the drive assembly.

In this embodiment, however, a spline connection 153 is associated with the transfer shaft 150TS and configured to enable the transfer gear 154 to move linearly along the transfer shaft longitudinal axis TLA. As one example, the transfer shaft 150TS includes a first shaft portion 151 and a second shaft portion 152 joined via spline connection 153. The spline connection can be any type of keyed connection that enables the first and second portions to slide in the direction S relative to one another, yet restrains rotation of the portions relative to one another.

Optionally, the first shaft portion 151 includes a splined end 151E. This splined end 151E can be disposed within a corresponding splined hole 152H defined by the second shaft portion 152. Via this splined connection, the first and second shaft portions are non-rotatable to another, yet can move toward and away from one another, or within one another along the transfer shaft longitudinal axis TLA.

In this embodiment, the first shaft portion and second shaft portion are generally movable linearly relative to one another along a transfer shaft longitudinal axis. Accordingly, the transfer gear 154, as well as the transfer block 151T and the secondary shaft 150SS also can move linearly and vertically, upward or downward, in directions L. In turn, this construction can maintain rotational coupling between the input shaft 106, the transfer shaft 150TS, the secondary shaft 150SS, and associated driveshaft and propeller shaft, even when the drive unit 120 is raised to the raised mode and/or lowered to the lowered mode. Thus, the propeller can continue to rotate and produce thrust, even when the drive unit is moved up or down in the boat, moving through the water.

A second alternative embodiment of the outdrive is shown in FIGS. 10-13 and generally designated 210. The structure, function and operation of this embodiment is similar to the embodiments described above with several exceptions. For example, this embodiment includes a drive unit 220 joined with a transom 102 of a boat 100 via a standoff box 230. The standoff box 230 includes a portion of a drive assembly 250, virtually identical to that described above, and the drive unit 220 includes the remainder of the drive assembly.

In this embodiment, however, standoff box 230 is situated on the transom 102 so that the reference line RL and the longitudinal axis LA of the propeller shaft 223 are in slightly different locations than the embodiments described above, relative to one another. For example, in the raised position in FIG. 10, the reference line RL is illustrated as being parallel to or slightly above the longitudinal axis LA. Optionally, the reference line RL can be offset 0 inches from the longitudinal axis LA. In other cases, the longitudinal axis LA can be disposed a preselected distance L4, for example 0, 1, 2, 3, 4, 5, 6 inches or increments thereof below the reference line RL.

Figure 10:
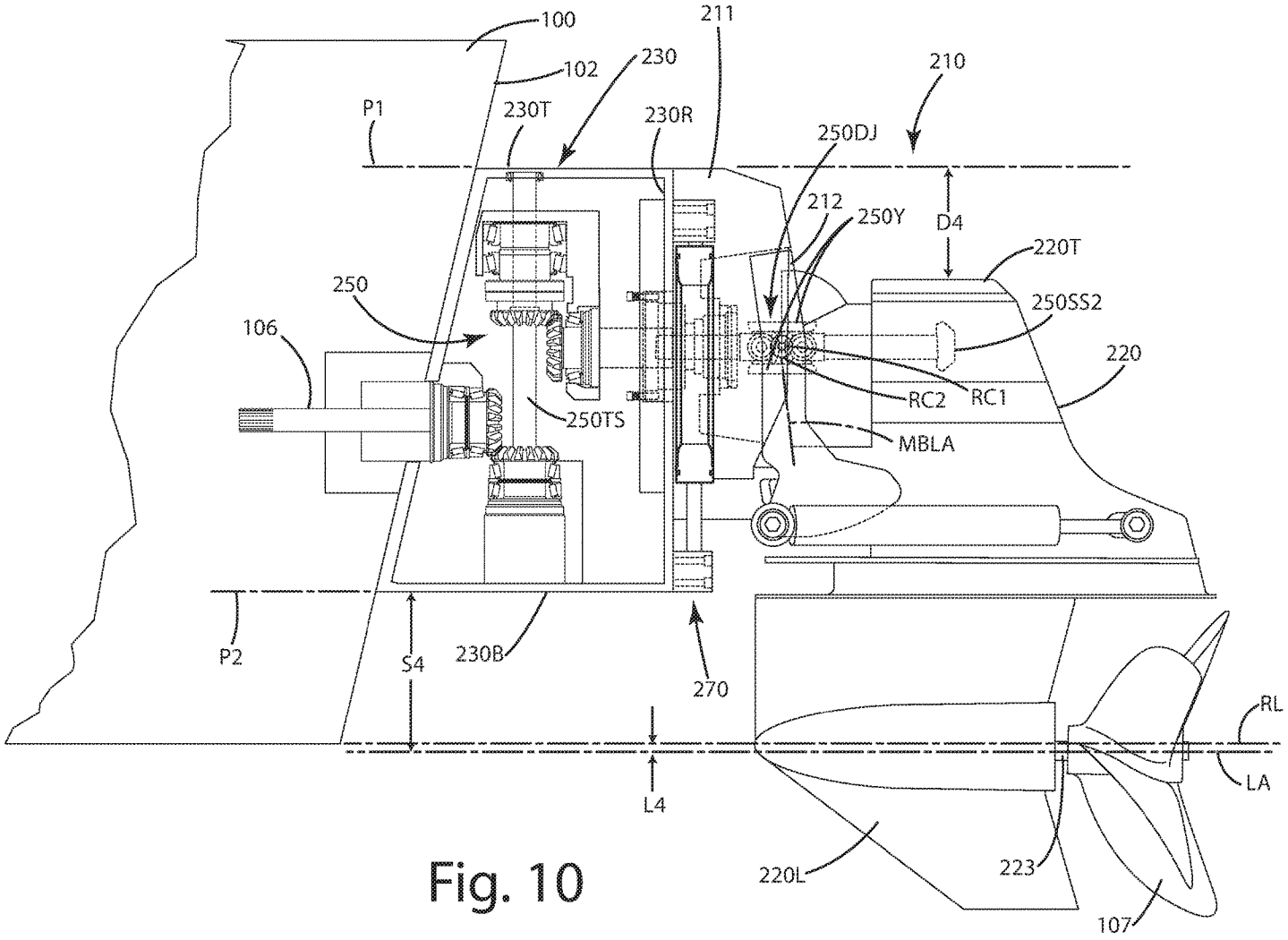
FIG. 10 is a side section view of a second alternative embodiment of the standoff box with a double universal joint and a vertical spacing assembly with the outdrive in a raised mode.

Optionally, the longitudinal axis LA can be disposed a small preselected distance L4, for example 0, 1, 2, 3, 4, 5, 6 inches or increments thereof above the reference line RL in the raised mode shown in FIG. 10. Optionally, when the outdrive is in the raised mode, the propeller shaft 223, and particularly its longitudinal axis LA, is disposed a first distance S4 (FIG. 10) from the standoff box, and in particular, from the plane P2 in which the lowermost portion of the standoff box and/or lower wall 230B lays. This first distance S4 can extend, for example 0, 1, 2, 3, 4, 5, 6, 7, 8, 9, 10, 11, 12, 24 inches or increments thereof, below the plane P2.

Figure 12:
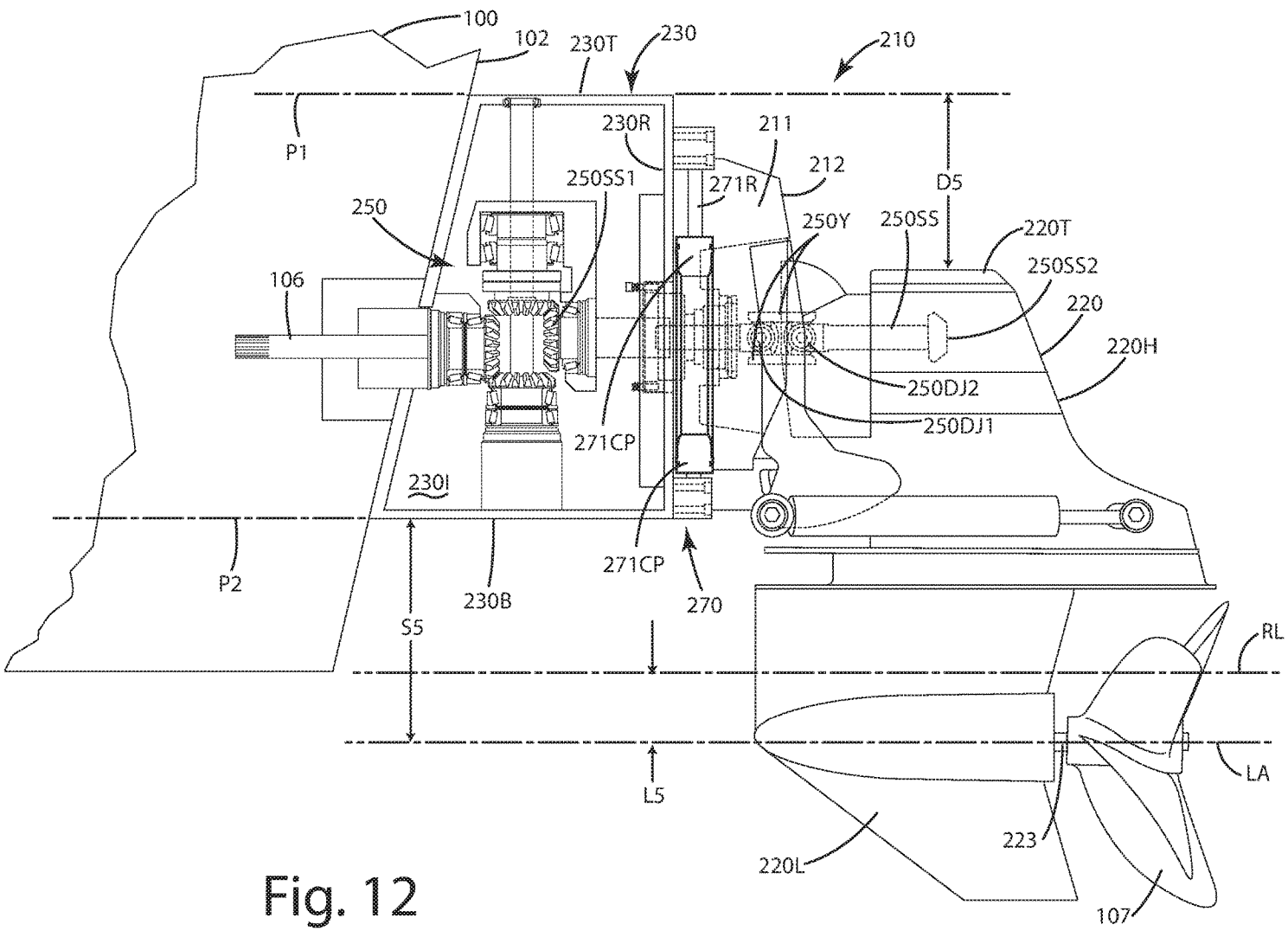
FIG. 12 is a side section view of a second alternative embodiment with the outdrive in a lowered mode.
Figure 13:
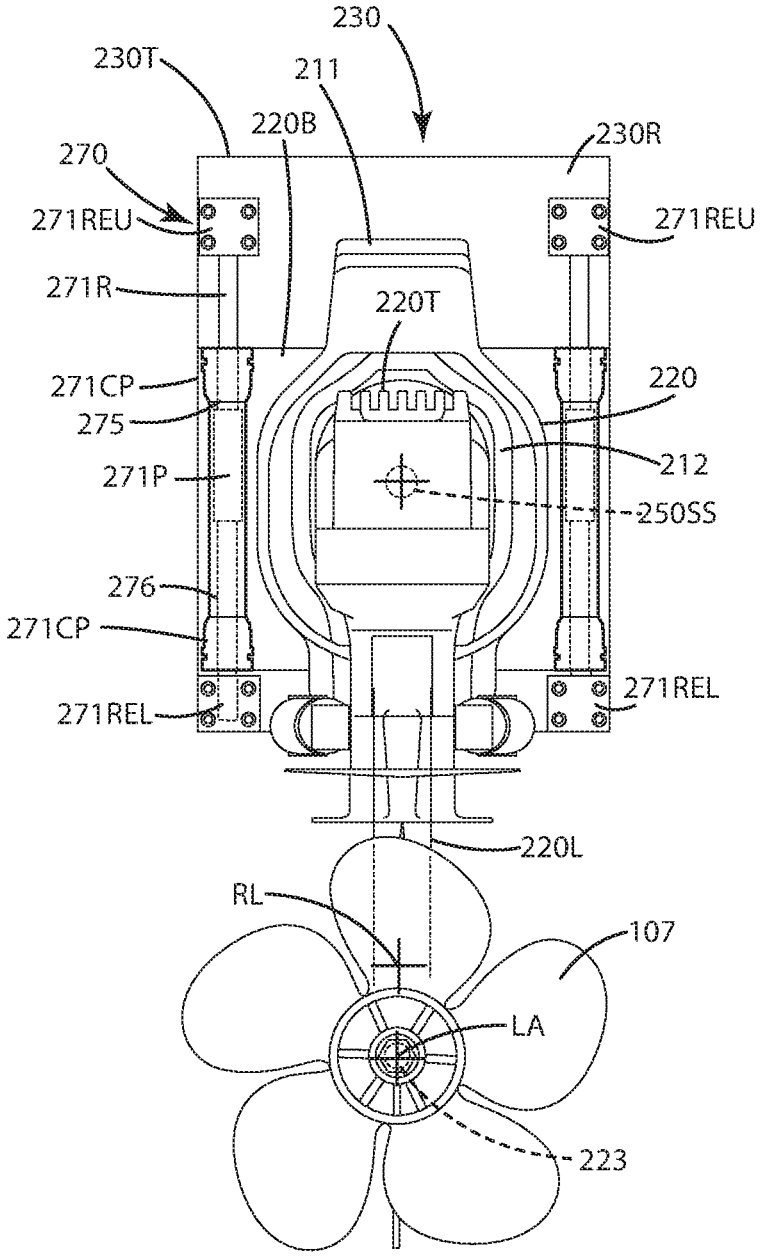
FIG. 13 is a rear view thereof.

The drive unit 220 can be guided and urged with the vertical adjustment assembly 270 to a lowered mode as shown in FIGS. 12 and 13. In this lowered mode, the top 220T of drive unit 220 moves downward relative to the upper wall 230T of the standoff box 230, and the plane P1 within which the uppermost portion of the standoff box and/or the upper wall lays, to a preselected distance D5. This distance D5 can be greater than distance D4, which is the distance between these elements when the outdrive 220 is in the raised mode shown in FIG. 10. D5 can be optionally 0, 1, 2, 3, 4, 5, 6 inches or increments thereof.

In this lowered mode, the propeller shaft 223 and its longitudinal axis LA can be aligned in parallel to the reference line RL, particularly when the outdrive is in a neutral tilt position, as shown in FIG. 10. In some cases, the longitudinal axis LA can be parallel to a plane within which the reference line RL lies in this lowered mode. In other cases, the longitudinal axis LA can be disposed a preselected distance L5, for example 0, 1, 2, 3, 4, 5, 6 inches or increments thereof below the reference line RL. Optionally, the longitudinal axis LA can be disposed a small preselected distance L5, for example 0, 1, 2, 3, 4, 5, 6 inches or increments thereof above the reference line RL in the lowered mode shown in FIG. 12.

Optionally, when the outdrive is in the lowered mode, the propeller shaft 223, and particularly its longitudinal axis LA, is disposed a second distance S5 from the standoff box, and in particular, from the plane P2 in which the lowermost portion of the standoff box and/or lower wall 230B lays. This second distance S5 can be greater than the first distance S4, for example 1, 2, 3, 4, 5, 6 inches or increments thereof greater than the first distance S4.

The outdrive 220 also can optionally be outfitted with a double universal joint 250DJ. This double universal joint can be disposed between the first secondary shaft gear 250SS1 and the second secondary shaft gear 250SS2, optionally about midway between the first and second ends of the shaft 250SS. This effectively can divide the secondary shaft 250SS into first and second portions that can be parallel and aligned with one another, or can be offset at some angle when the outdrive 220 is rotated in a watercraft turning operation or tilted during a tilting operation. The double universal joint 250DJ can include center yokes 250Y that join two opposing universal joints 250DJ1 and 250DJ2, allowing the double universal joint to operate similar to a homokinetic or constant velocity joint. The double universal joint 250DJ can include a center of rotation RC1, shown in FIG. 10. This center of rotation RC1 can be in the same location as a center of rotation RC2 of the gimbal ring 212. With this double universal joint construction and common location of the two centers of rotation, the outdrive 220 can be tilted with minimal strain and minimal stress. Further, minimal inefficiencies are born by the rotating secondary shaft and other components during that tilting operation.

The outdrive also can be turned left or right during a watercraft turning operation. To ensure minimal strain, minimal excessive torque and minimal inefficiencies are born by the rotating secondary shaft during that turning operation, the center of rotation RC1 also can be located on an axis of rotation MBLA, which corresponds to an axis about which the outdrive and gimbal ring can rotate relative to the mounting bracket.

The outdrive 220 can be outfitted with a different vertical adjustment assembly 270 than that described above in connection with the other embodiments. With reference to FIGS. 10-13, the components and operation of the vertical adjustment assembly 270 will be described in further detail. To begin, the vertical adjustment assembly 270 is the component of the outdrive 220 that moves the drive unit vertically, and generally relative to the standoff box 230. Depending on the particular application, the various components of the vertical adjustment assembly can be joined with the mounting bracket 211 and the standoff box 230 respectively. Further, the vertical adjustment assembly can be operated remotely, for example, from a cabin, a helm, near a steering wheel and/or at an operator station via electrical, manual, hydraulic pneumatic or other controls to provide the desired raising and/or lowering of the outdrive relative to the standoff box.

Figure 11:
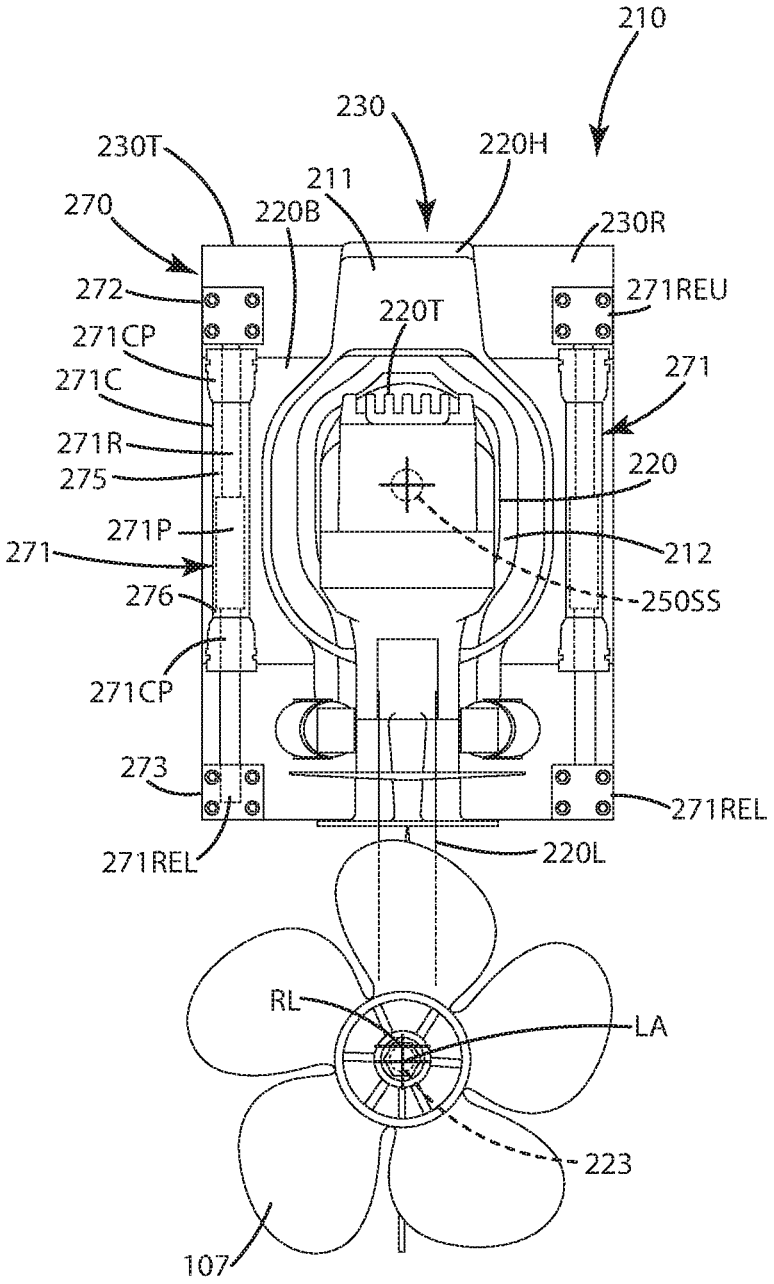
FIG. 11 is a rear view thereof.

With reference to FIGS. 11 and 13, the vertical adjustment assembly 270 can be joined with and/or included as part of the standoff box, and optionally the rear wall 230R, as well as the mounting bracket 211. The vertical adjustment assembly 270 can include first and second actuators 271. These actuators can be virtually identical to one another, and located on opposite sides of the propeller longitudinal axis LA or some other line of symmetry. Due to their similar construction, only one of the actuators will be described herein. The actuators 271 also can be disposed symmetrically across from one another on opposite sides of the standoff box 230. This can provide a balanced application of force to raise and lower the drive unit 220 relative to the standoff box 230.

The actuators 271 can be in the form of hydraulic, pneumatic or other types of cylinders with a piston 271P fixedly mounted on a ram or rod 271R. The rod 271R can include upper 271REU and lower ends 271REL. Each of these ends can be fixedly and immovably joined with the standoff box 230 for example, its rear wall, optionally via brackets 272 and 273. In this manner, the rods and brackets are immovable relative to the rear wall or standoff box in general. The brackets themselves can be fastened with fasteners or other devices to the standoff box.

The piston 271P can be disposed within a cylinder 271C that is defined by a block 220B or other part that is fixedly included in or joined with the transom mount 211. One or more end caps 271CP can close off the opposing ends of the cylinder 271C. The caps can include sealed openings that enable the rod 271R to extend therethrough. Cavities 275, 276 can be formed between the piston 271P and the caps 271CP on opposing ends of the piston. The filling and emptying of these cavities with fluid can effectively push the caps 271CP away from the piston 271P. Because the cap is fixedly mounted to the block 220B and the mount 211, this movement causes these elements and the outdrive 220 to move relative to the standoff box 230 and its rear wall 230R.

For example, as shown in FIG. 10, when the outdrive 220 is in a raised position and it is suitable to lower the outdrive, a user can operate a control that introduces fluid into the cavity 276 and expels fluid from cavity 275. This causes the bottom cap 271CP to move downward away from the piston 271P, and the top cap to move toward the piston. The caps are joined with the block, mount and outdrive, and accordingly these elements move downward relative to the standoff box and its rear wall. This continues until a desired lowering level of the outdrive 220 is achieved, for example, when the level shown in FIG. 12 is achieved, where the piston 271P is at the top of the cylinder, optionally abutting the top cap 271CP. Of course, an infinite number of levels can be achieved via movement of the piston within the cylinder. Thus, the propeller shaft and its axis can be moved relative to the reference line to precisely orient the thrust of the outdrive depending on the application.

Optionally, the left and right actuators 271 can be in a common fluid or hydraulic circuit so that the actuators simultaneously, consistently and evenly move the block 220B, and mounting plate 211 to move these elements, and the drive unit 220, along with all of its components, in an even and level manner upward and downward to and from the various modes.

Further optionally, the precise fitment of the pistons in the cylinders, and movement of the caps relative to the rods, can provide a level of guidance. In some cases, these elements of the vertical adjustment assembly 270 can provide a smooth, guided, and even consistent raising and lowering of the outdrive 220 relative to the standoff box 230. Of course, other types of guides, such as rods, bars or the like can be added to the construction and/or substituted for the elements of the vertical adjustment assembly to provide a guiding interface so that the outdrive can move consistently and evenly, and a non-binding manner relative to the standoff box, when moving from the raised mode to the lowered mode and vice versa.

Figure 14:
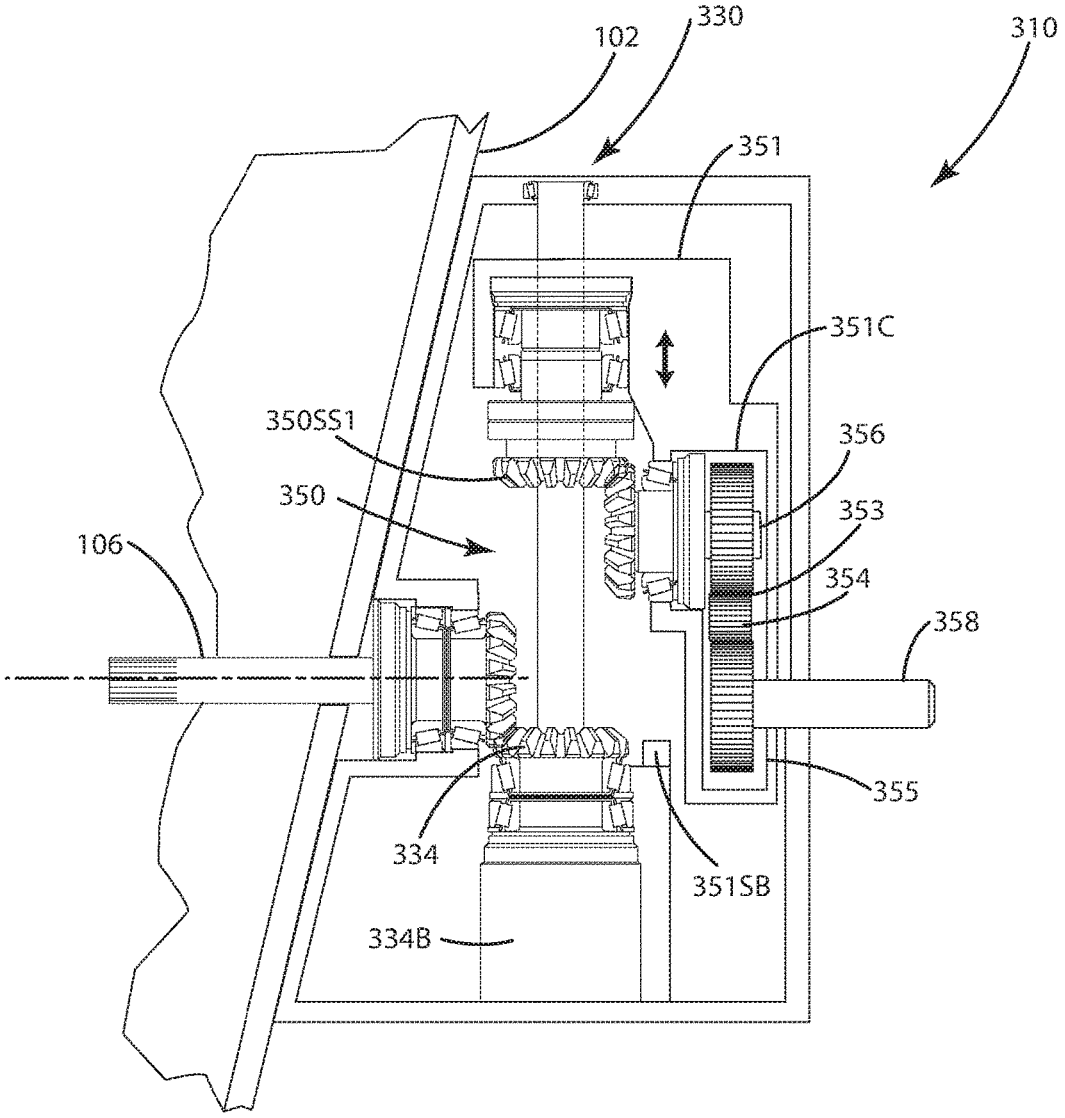
FIG. 14 is a side section view of a third alternative embodiment of the standoff box with a secondary shaft offset gear assembly.

A third alternative embodiment of the outdrive is shown in FIG. 14 and generally designated 310. FIG. 14 primarily shows the drive assembly 350 and the standoff box 330, however, it does not show the drive unit or its components. It will be appreciated that the other drive units and components from the embodiments herein are readily suitable for the drive assembly and standoff box shown in FIG. 14. The structure, function and operation of this embodiment are similar to the other embodiments described herein with several exceptions. For example, this embodiment includes a drive unit (not shown) joined with a transom 102 of a boat 100 via a standoff box 330. The standoff box 330 includes a portion of a drive assembly 350, virtually identical to that described above. The drive assembly, however, can include a transfer block 351 that is configured to facilitate a greater offset of the transfer shaft relative to the input shaft 106. In turn, this can prevent unsuitable interference of the transfer gear 334 with the secondary shaft gear 350SS1, particularly when the transfer block is lowered to its lowermost position when an associated drive unit is lowered to a lowered mode. This construction also can enable the drive unit to be lowered more than other embodiments herein having different transfer blocks.

The transfer block 351 can define a cavity 351C that houses a set of gears 353, 354 and 355. The first gear 353 can be fixed to a first secondary shaft 356. The second gear 355 can be fixed to a second secondary shaft 358 that extends to an associated drive unit. Between the first and second gears, an intermediate gear 354 can be rotatably disposed. This gear can ensure that the first and second gears rotate in the same direction. With this set of gears, the second secondary shaft can be moved to a lower vertical position, without the gears associated with the transfer block interfering with the gears associated with the input or transfer shaft.

Optionally, although not shown, the various gears 353, 354 and 355, as well as the secondary shafts, can be mounted in bearings, bushings and/or sleeves associated with the transfer block 351 to facilitate rotation, alignment and longevity.

Further optionally, the standoff box of this embodiment or other embodiments herein can be outfitted with a stop block 351SB that stops the transfer block 351 from lowering beyond a position that would enable the gears 350SS1 and 334 to engage and interfere with one another. This stop block can be joined with the base 334B, or alternatively some part of the standoff box and/or the transfer block. In other cases, the stop block can be in the form of a threaded fastener so as to enable a user to define a particular stop point for the transfer block when it descends toward the bottom wall of the standoff box 330.

A fourth alternative embodiment of the outdrive is shown in FIGS. 15-20 and generally designated 410. The structure, function and operation of this embodiment is similar to the embodiments described above with several exceptions. For example, this embodiment includes a drive unit 420 joined with a transom 102 of a boat 100 via a standoff box 430. The standoff box 430, however is partitioned into an upper standoff box unit 431 and a lower standoff box unit 432. The upper unit 431 is stationary and fixed relative to the transom, while the lower unit 432 is movable with the drive unit 420, relative to the watercraft and the upper unit, when the outdrive transitions from a raised position shown in FIG. 15 to a lowered position show in FIG. 19. The drive unit 420 also can be specially outfitted with an upper drive unit housing 420H that houses a transmission and/or a clutch 450C to enable an operator to select forward, reverse or neutral from a remote location on the watercraft. This outdrive 410 also can include a different drive assembly 450 compatible with the split standoff box configuration, as well as a different vertical spacing assembly 470, as described below.

The various structures of this embodiment will now be described in more detail. To begin, this embodiment includes many of the same watercraft features as the embodiments above. For example, an engine (like the ones above) is joined with an input shaft 106 that extends rearward from the engine and through a hole 102H in the transom 102 of the watercraft 100. The standoff box 430, however, can include an extension 430E that fits within the hole 102H. The extension 438 can extend at least partially through the hole 102H. Although not shown, this extension 438 can be secured with a bracket or to the transom 102, or to a portion of the engine via fasteners (not shown). The extension 430E can include a bearing 430EB that assists and facilitates rotation of the input shaft 106 within the extension and where the shaft projects into an interior 431I of the standoff box 430, and in particular the interior of the upper standoff box unit 431. The hull hole 102H is sealed so that water cannot enter through the hole into the hull.

The extension 430E can be joined with an upper standoff box unit 431. This upper standoff box unit can optionally be a housing and can include a forward wall 431F and a rearward wall 431R as well as an upper or top wall 431T and a lower bottom wall 431B. The top wall 431T optionally can be removable from the unit 431 to provide access to the ball spline unit 453 and transfer shaft 450TS. The rearward wall 431R can be substantially vertical. In this case, the front wall 431F and rear wall 431R may not be parallel. The upper and lower walls however can be parallel to another and to the bottom of the boat, or parallel to the transom. The input shaft 106 can extend to and can be joined non-rotatably with a bevel gear 106B. This bevel gear 106B can be disposed adjacent and can interface with a transfer shaft gear 434. This transfer shaft gear 434 can be fixed non-rotationally to the transfer shaft 450TS. For example, the shaft 450TS can be keyed, and the gear 434 can include a keyhole. Alternatively, one of the shaft or gear can be splined and the other can include a corresponding spline hole to prevent rotational movement between the transfer shaft and the transfer shaft gear. These elements, however, can be linearly movable so that the transfer shaft can move along a transfer shaft longitudinal axis TLA effectively through the transfer shaft gear 434.

The drive assembly 450 also can include a ball spline unit 453. This ball spline unit can include a ball spline 452 similar in structure to the ball spline described above in connection with the embodiments above and herein. In general, the ball spline can enable the transfer shaft 450TS to move linearly through the ball spline relative to other components of the outdrive for example the top wall, bottom wall and other sections of the upper standoff box unit 431. The ball spline however is non-rotatably coupled to the transfer shaft 450TS so that these two components do not rotate relative to one another. Thus the ball spline 452 and the transfer gear 434 rotate in unison with one another. Again, due to the ball spline bearings in various raceways described in the embodiments above, the transfer shaft 450TS can move along a transfer shaft longitudinal axis TLA up-and-down within the interior 431 of the upper standoff box unit 431 as described further below and as described in connection with the other embodiments. The ball spline unit 453 can include a set of bearings 453B that enables the ball spline 452 to rotate within the bore 431BO are defined between the front wall 431F and the rear wall 431R of the upper standoff box unit 431.

Figure 15:
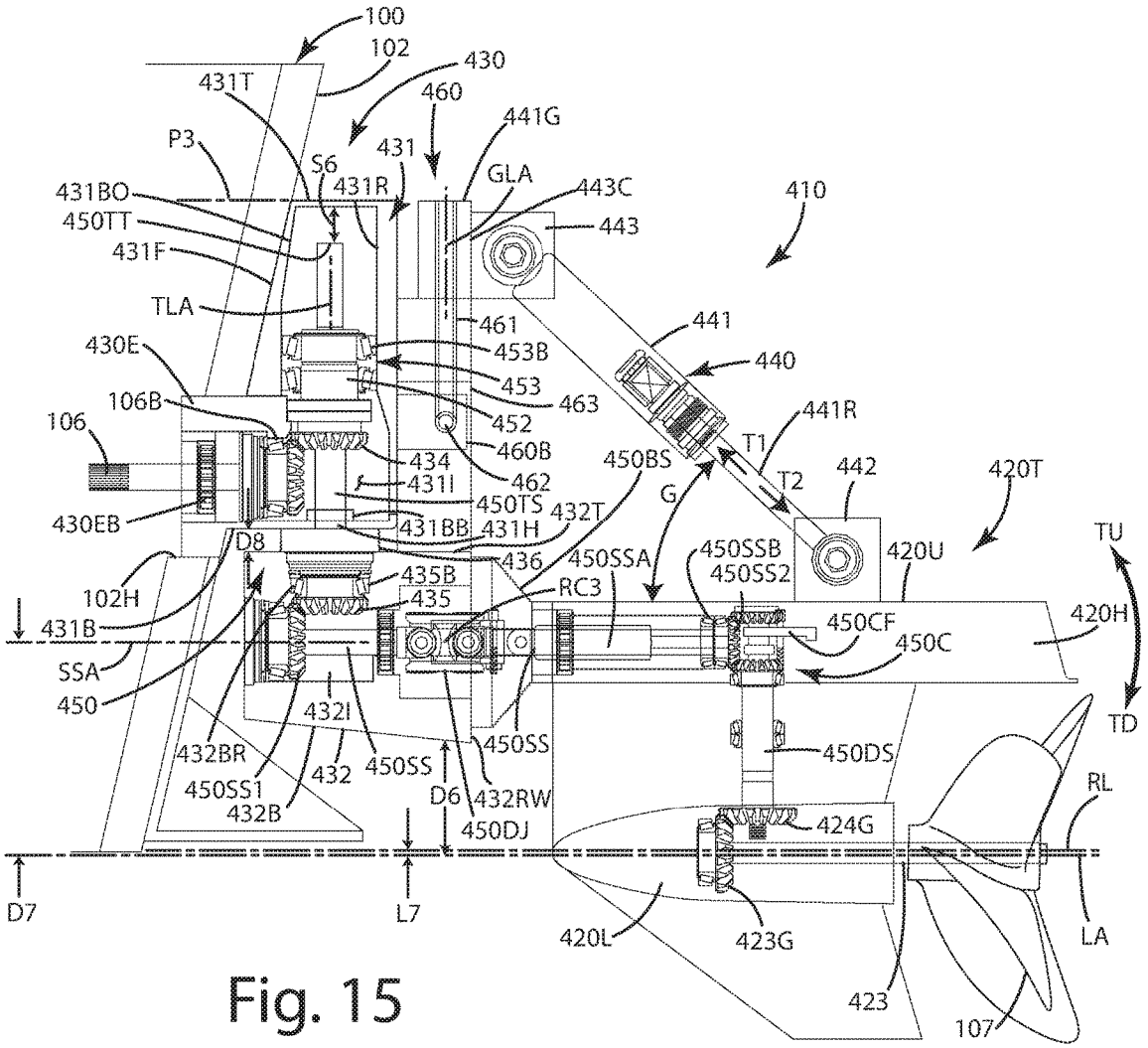
FIG. 15 is a side section view of a fourth alternative embodiment of the standoff box in a split configuration with a drive unit and a vertical spacing assembly with the outdrive in a raised mode.

The standoff box upper unit 431, as mentioned above can include a bottom wall 431B. This bottom wall can define a hole 431H through which the transfer shaft 450TS extends. Adjacent the hole, a set of bearings or bushings 431BB can be disposed. As shown in FIG. 15, the transfer shaft 450TS extends outward and exits the upper standoff box unit 431, through the bottom wall 431B and in particular the hole 431H. Indeed, the transfer shaft 450TS moves relative to this bottom wall and hole. The transfer shaft 450TS can be concealed and otherwise shielded from the water environment in which the outdrive is disposed via a bellows 436. The bellows is expandable and retractable, and remains connected to the upper standoff box unit 431, as well as the lower standoff box unit 432 during all movement. In this manner, the bellows forms an enclosure within which the transfer shaft can move, without oil grease or other materials being expelled into the surrounding water, or the surrounding water contacting the bushings, bearings and other components adjacent the transfer shaft 450TS.

Figure 18:
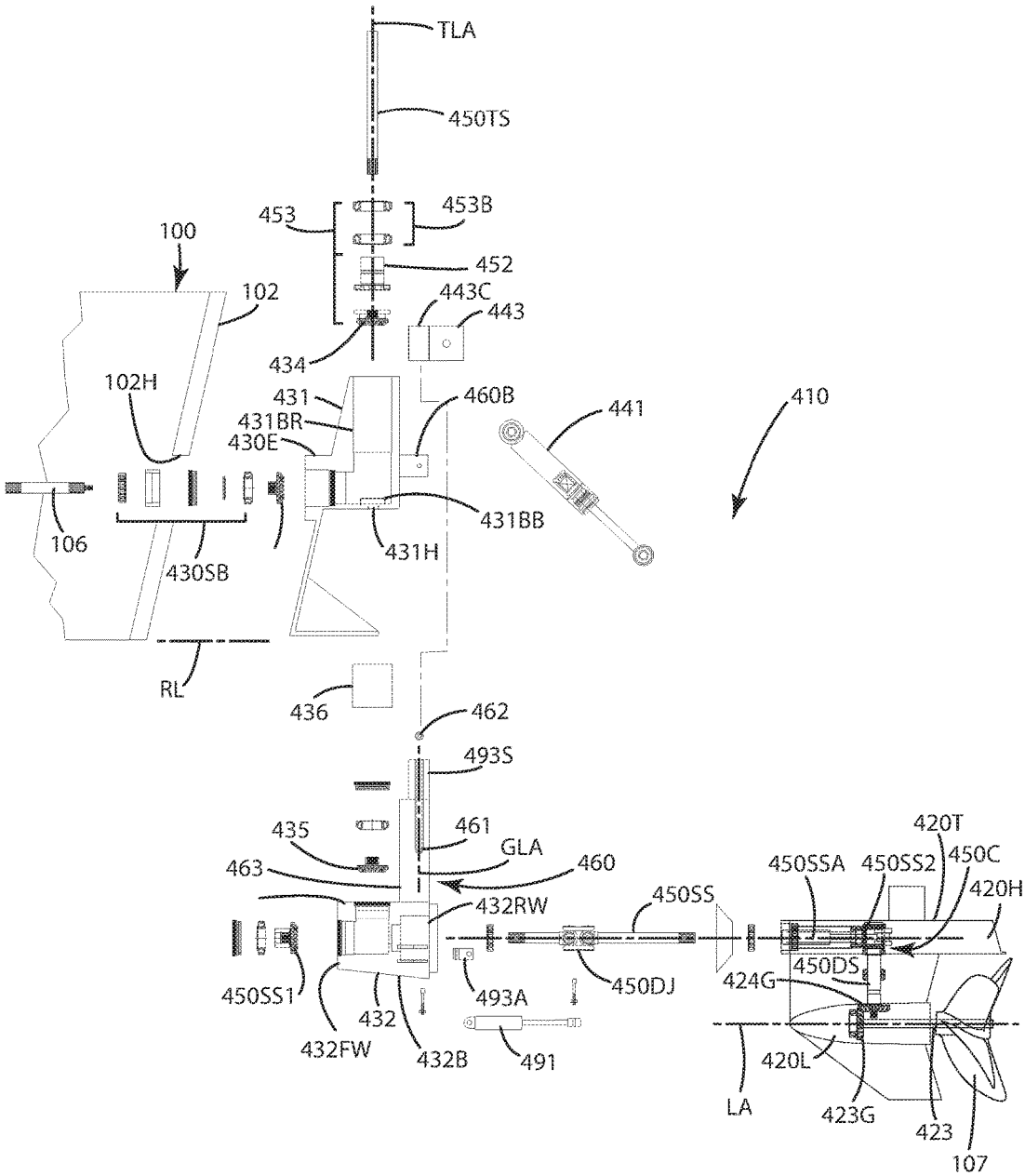
FIG. 18 is an exploded side view thereof.

As shown in FIGS. 15 and 18 the transfer shaft 450TS extends into the lower standoff box unit 432, in particular, into its interior 4321. In the interior, the distal end of the transfer shaft 450TS can be joined with a secondary transfer shaft gear 435. The secondary transfer shaft gear 435 can be non-rotatably joined with the transfer shaft, for example, via splines. Adjacent the gear and/or transfer shaft, a set of bearings 435B can be disposed to facilitate smooth rotation of the transfer shaft and the gear within the interior cavity 4321 of the lower standoff box unit 432.

Optionally, the lower standoff box unit 432 can be in the form of a housing, and can include an upper or top wall 432T, distal from a bottom wall 432B. The transfer shaft can extend through the top wall 432T, but not the bottom wall 432B of the lower unit. It, and the bearings and/or gear 435 can be disposed in a vertical bore 432BR of the lower standoff box unit 432. This bore 432BR generally can form at least a portion of the interior cavity 4321. Within the interior cavity 4321, a secondary shaft 450SS is rotatably disposed. The secondary shaft 450SS can be transverse, for example, perpendicular to the transfer shaft 450TS. Indeed, the respective axes of the shafts, for example, axis TLA and axis SSA can be perpendicular to one another. This perpendicular orientation can be maintained when the drive unit 420 is raised and/or lowered as described in further detail below.

The lower standoff box unit 432 also houses a first secondary shaft gear 450SS1. This gear can be mounted directly to the secondary shaft 450SS. These two components can be non-rotatable relative to one another via a mechanism, for example a spline connection between these components. The secondary shaft 450SS can extend to a double articulating or U-joint 450DJ, which is identical to the double U-joint and double articulating joints described in the other embodiments herein. The center of rotation RC3 of the double U joint 450DJ in this construction can be aligned with and parallel to a longitudinal axis of rotation GLA of a movable or rotatable tilt guide 441G associated with the tilt assembly 440 as described in further detail below.

The secondary shaft 450SS can extend through the rearward wall 432RW of the unit 432. In particular, a second portion 450SSA of the secondary shaft 450SS rearward of the double articulating joint 450DJ extends into a housing 420H of the drive unit 420. The secondary shaft can be associated with and/or non-rotatably joined with a second secondary shaft gear 450SS2 which is disposed within that housing 420H. The secondary transfer gear 435, as mentioned above, rotatably engages the first secondary shaft gear 450SS1. Accordingly, when the secondary transfer gear 435 rotates, it rotates the first secondary shaft gear associated with a first end of the secondary shaft 450SS. In turn, the secondary shaft 450SS as well as its double articulating joint 450DJ and its second portion 450SSA also turn. As a result, due to the rotatable coupling of the secondary shaft to the driveshaft 450DS, via the clutch 450C described further below, this rotates the driveshaft 450DS and ultimately the propeller 107 as described further below.

As shown in FIG. 15, the housing 420H can be joined with a portion of the standoff box 430, and in particular the lower standoff box unit 432. The housing 420H can be joined via a large ball joint (not shown) so that the housing 420H can articulate horizontally and vertically relative to the lower standoff box unit 432, while still enabling the secondary shaft 450SS to rotate and engage the clutch 450C and/or driveshaft 450DS. Optionally, between the housing 420H and the lower standoff box unit 432, another bellows 436 can be disposed. This bellows can provide a watertight seal around the rotating secondary shaft 450SS and optionally around at least a portion of the double articulating joint 450DJ. The bellows can isolate the double joint and any other working components from the water environment within which the outdrive 410 is disposed. It also can prevent contaminants such as grease and oil from leaking into that water environment.

As mentioned above, the secondary shaft 450SS is joined with a second secondary shaft gear 450SS2. The gear can be in the form of a bevel gear. The shaft portion 450SSA can be rotatably mounted in a set of bearings 450SSB. The second secondary shaft gear 450SS2 can directly engage the clutch 450C.

As shown in FIG. 15, this clutch 450C can operate and can include similar structure to the clutch 50C described in the embodiments herein. For example, when it rotates, the secondary shaft 450SS rotates the second secondary shaft gear 450SS2, which in turn engages clutch 450C disposed in the housing of the drive unit 420. This clutch 450C can be a cone clutch, and can be operated with a gear selecting fork 450CF. Via the clutch and the gear selector, a user can remotely (from elsewhere on the watercraft, for example, at a helm, adjacent a steering wheel, or at a control center of the watercraft inside or above the hull) select neutral, forward, or rearward propulsion via the outdrive. Exemplary cone clutches and gear selectors are disclosed in U.S. Pat. No. 6,960,107 to Schaub and U.S. Pat. No. 6,523,655 to Behara, both of which are incorporated by reference herein in their entirety. Of course, other types of clutches and gear selectors can be utilized. In some limited cases, the clutch 450C can be absent from the drive unit housing 420H, and can instead be placed in the lower housing 420L, within the standoff box, and/or inside the hull of the watercraft, depending on the application.

The clutch 450C, as illustrated, is selectively coupled to the driveshaft 450DS. As mentioned above, the driveshaft is further rotatably coupled to the propeller shaft 423 which itself is non-rotatably joined with the propeller 107. In operation, the input shaft 106 rotates the transfer gear 434, which rotates the transfer shaft 450TS. The transfer gear rotates the secondary transfer shaft gear 435. This in turn rotates the first secondary shaft gear 450SS1. This rotational force is transferred through the connected secondary shaft 450SS. The secondary shaft, via a second secondary shaft gear 450SS2 associated with a second end of the secondary shaft, engages one of the two gears associated with the drive shaft 450DS with bearings between the components. One at a time, the two gears can engage the clutch 450C when the clutch 450C is moved up or down. The secondary shaft gear 450SS2 thereby transfers rotational force to the driveshaft 450DS through the gears and the clutch arrangement. Accordingly, upon rotation of the driveshaft 450DS, it rotates the gears 424G and 423G, the propeller shaft 423 and the propeller 107. This rotation of all the elements of the drive assembly 450 occurs while the drive assembly is under power and rotating via input from the input shaft 106. The rotation of all these components can occur equally and similarly in both the raised mode and lowered mode of the drive unit 420.

Figure 17:
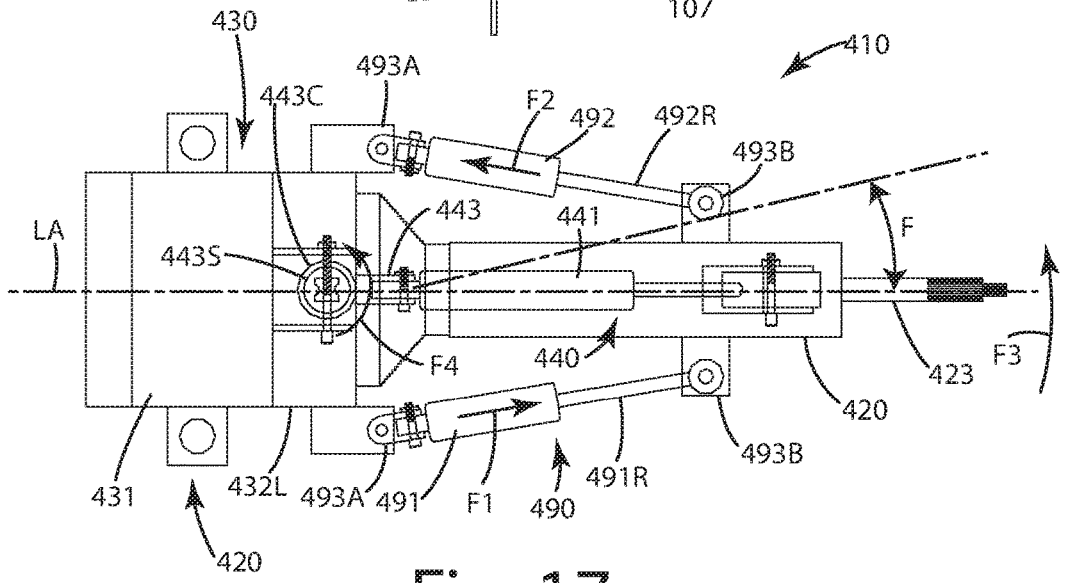
FIG. 17 is a top view thereof.
Figure 19:
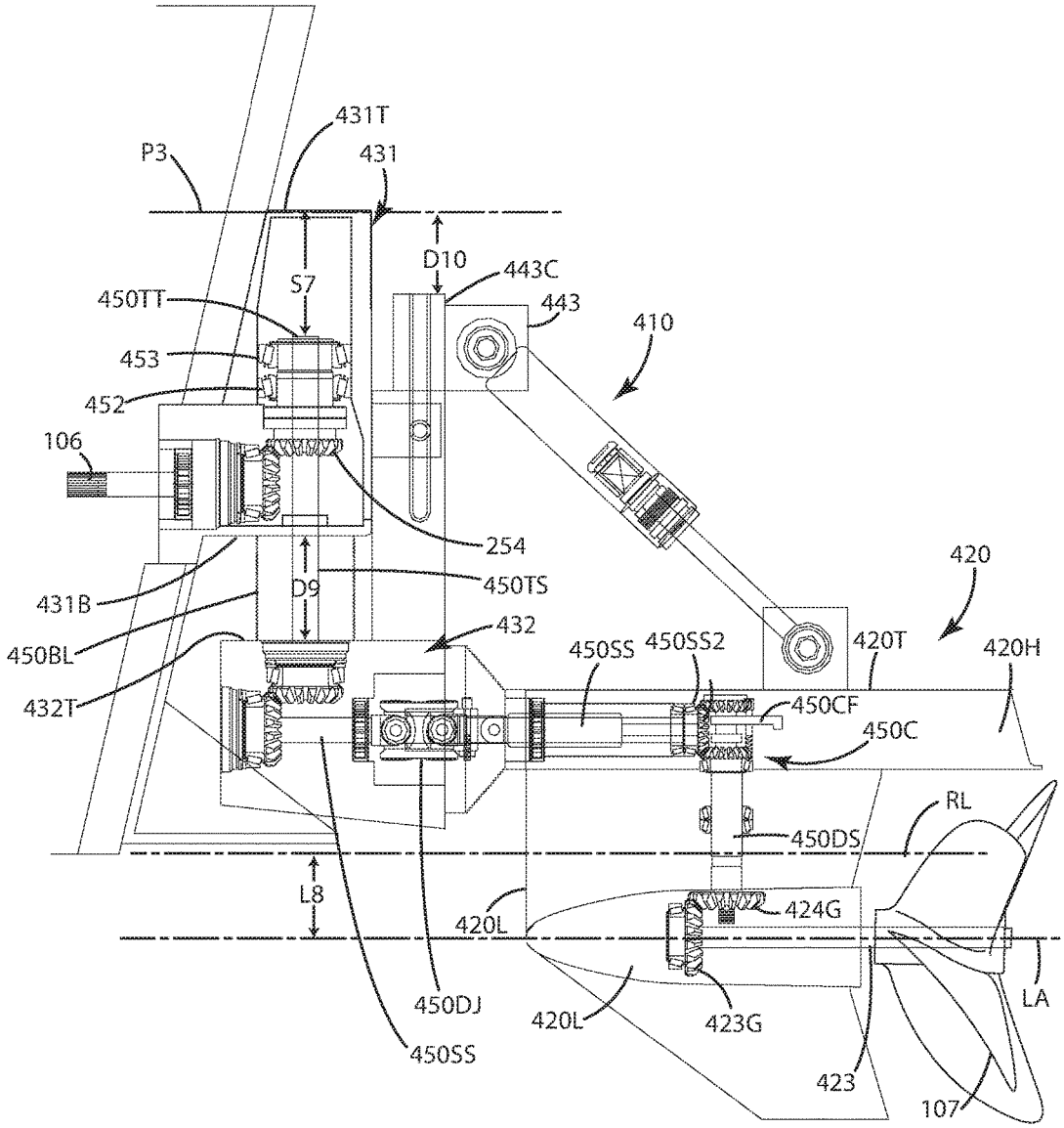
FIG. 19 is a side partial section view of the fourth alternative embodiment with the outdrive in a lowered mode.
Figure 20:
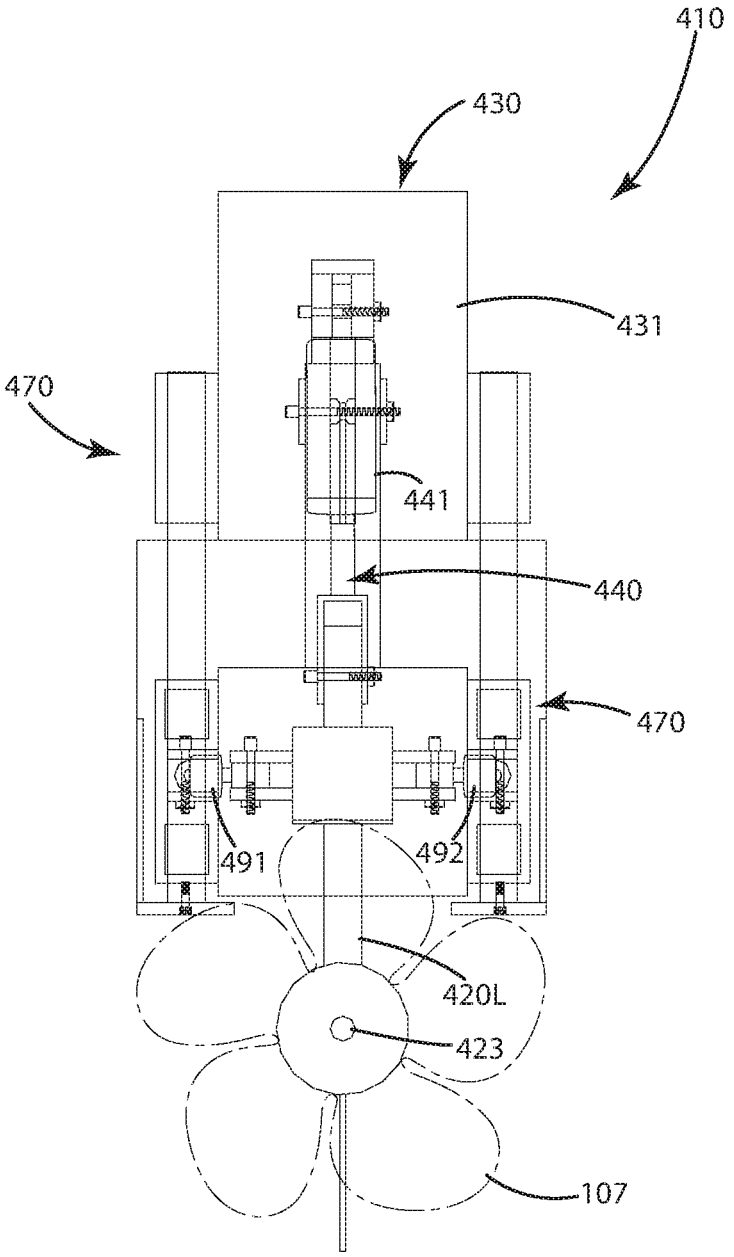
FIG. 20 is a rear view thereof.

With reference to FIGS. 15, 17 and 19, the operation of the outdrive 410, and in particular the drive assembly and standoff units, can be better understood. On a high level, the lower standoff box unit 432 is movably coupled to the upper standoff box unit 431. The lower unit 432 however is joined via a system of joints and shafts to the drive unit 420 and the respective housings 420H and 420L. These housings 420H and 420L can be tilted and/or moved relative to the lower standoff box unit 432 and/or the upper standoff box unit 431 with the tilt assembly 440 and/or a turning system 490 as described further below.

More particularly, the vertical spacing assembly 470 can be actuated to move the drive unit 420 from the raised mode shown in FIG. 15 to the lowered mode shown in FIG. 19 and vice versa depending on the maneuvers of the watercraft. As an example, with reference to FIG. 15, the reference line RL extending out the bottom of the boat is generally aligned with the longitudinal axis LA of the propeller shaft 423. In this configuration, the propeller shaft longitudinal axis LA is at a fixed distance D6 and in a fixed but tiltable (via the tilt assembly) angular orientation relative to the bottom wall 432B of the lower standoff box unit 432. The propeller shaft longitudinal axis LA also is at a variable distance D7 from the bottom 431B of the upper standoff box unit 431. In transitioning from a raised mode to a lowered mode, the distance D6 remains constant while the distance D7 can increase. In transitioning from the lowered mode to the raised mode, the distance D6 again can remain constant while the distance D7 can decrease.

The special relationship of the upper and lower standoff box units as well as the transfer shaft relative to these components and others also can vary in transitioning from the raised mode of FIG. 15 to the lowered mode of FIG. 19. For example, when the lower standoff box unit 432 is in the raised mode of FIG. 15, the upper or top end 450TT of the transfer shaft 450TS is a distance S6 from the top 431T of the upper standoff box unit. Likewise, the bottom wall 431B of the upper standoff box unit 431 is a distance D8 from the top wall 432T of the lower standoff box unit 432 in this raised mode. Upon actuation of a vertical spacing assembly 470 which can be similar to any of those in the embodiments above, the lower standoff box unit 432 moves vertically downward to attain the position shown in the lowered mode of FIG. 19. In so doing, the transfer shaft 450TS moves relative to the ball spline unit 453 and the respective ball spline 452. This motion occurs with the ball spline and transfer gear 434 rotating in unison along with the secondary transfer gear 435. The shaft 450TS, however, slides linearly through the ball spline as these elements rotate in unison. As the transfer shaft moves down, its top 450TT moves to a second distance S7 (FIG. 19) from the top 431T of the upper standoff box unit 431. This distance S7 is greater than the distance S6 of FIG. 15. During this movement, the upper top wall 432T of the lower unit 432 also moves to a second distance D9 from the bottom wall 431B of the upper standoff box unit 431. This distance D9 in the lowered mode is greater than the distance D8 in the raised mode. During this movement, the bellows 450BL also elongates and expands, all while surrounding and concealing the transfer shaft 450TS from the surrounding water environment. As the drive unit 420 and associated propeller shaft 423 move during the movement of the lower standoff box unit 432, the longitudinal axis LA of the propeller shaft 432 moves from a distance L7 relative to the reference line RL of FIG. 15 in the raised mode, to the distance L8 below the reference line RL as shown in FIG. 19. These distances can correspond to any of the other distances in the embodiments described above in connection with moving to and from the raised and/or lowered modes. Again, during all of this movement, the input shaft 106 rotates the transfer shaft 450TS which in turn rotates the secondary shaft 450SS and thus the drive-shaft 450DS and the propeller shaft 423 to rotate the propeller 107. Accordingly, as the boat moves with water, the vertical spacing of the longitudinal axis LA of the propeller shaft 423 can be varied relative to the bottom of the boat, the reference line and/or the bottom wall of the upper standoff box unit 431. Utilizing the vertical adjustment assembly 470, an operator also can move these elements to an infinite number of intermediate positions to fine-tune the thrust point of the propeller and maximize speed in or maneuverability for the watercraft 100.

As mentioned above, the outdrive 410 can be outfitted with a steering assembly 490. With reference to FIGS. 17 and 18, the steering assembly 490 can include a first actuator 491 and a second actuator 492 disposed on opposite sides of the longitudinal axis LA. These actuators 492, 491 can be in the form of hydraulic, pneumatic or other extendable and retractable actuators or set of gears. The actuators 491 and 492 can operate in unison, one extending, the other retracting during a turning operation. These actuators each can be attached via respective brackets to the drive unit 420 and the lower standoff box unit 432. For example, actuator 491 can be attached to the drive unit 420 via bracket 493B. The opposing end of the actuator 491 can be attached to the lower standoff box unit 432 via the second bracket 493A. The ends of the actuator can be rotatably connected to these brackets so that during a turning operation the various components pivot relative to one another. For example, when a user at a location distal or remote from the outdrive 410 wants to turn the watercraft in a particular direction, the user can actuate a controller (not shown) to extend the ram 491R in direction F1 of the actuator 491. The other actuator 492 can move or retract the ram 492R. Because these elements and actuators are connected to the housing and to the standoff box, the drive unit 420 rotates in direction F3. In turn, the longitudinal axis LA also moves in direction F3 to an offset or turning angle of F. To turn in a direction opposite of F3, the actuators can be operated in a reverse manner.

As mentioned above, the outdrive 410 can be outfitted with a tilt assembly 440. This tilt assembly, shown in FIGS. 15 and 17, can include an actuator 441. The actuator can be any hydraulic, pneumatic or other extendable and retractable actuator or set of gears depending on the application. The actuator shown is in the form of a hydraulic cylinder which can be coupled via a circuit to a control associated with the watercraft 100, remote from the outdrive 410. The actuator 441 can be pivotally attached via a first bracket 442 to the drive unit 420 and in a particular an upper surface 420U of the housing 420H. The second, opposing end of the actuator 441 can be pivotally attached via a bracket 443 to a spindle 493S. The bracket 443 can include a cylindrical portion 443C that is rotatably mounted on a spindle 493S as shown in FIG. 18. Via this mounting, the bracket 443 effectively forms a guide 441G so that the bracket 443 and actuator 441 can rotate about a guide longitudinal axis GLA (FIG. 15) associated with the spindle 493S during a turning operation.

Accordingly, as shown in FIG. 17, when the outdrive 410 is turned in direction F3, the guide and bracket also move in direction F4 which is the same direction as F3. In this manner, the tilt actuator 441 can rotate with the housing 420H, all while its angular orientation relative to the standoff box changes. In operation, the tilt actuator 441 can move the ram 441R and direction T1. When this occurs, the housing 420H and its components, for example the propeller shaft 423 and its associated longitudinal axis LA tilt upward in direction TU. This in turn changes the angle of the propeller shaft longitudinal axis LA relative to the bottom of the boat, similar to the tilting action of the embodiment 10 in FIG. 3. When the rod extends in direction T2, the drive unit 420 and associated propeller shaft 423 and its longitudinal axis LA tilt downward in direction TD, similar to the tilting action of the embodiment 10 in FIG. 4. The associated angles and spatial orientations can be similar to that embodiment as well.

During the tilting action, the portion of the secondary shaft 450SSA also can tilt downward in direction TD. Due to the double universal joint 450DJ, however, this does not affect the transfer of rotational force to that portion, the clutch and ultimately the driveshaft and propeller shaft 423. Optionally, as described in connection with the embodiments above, the tilt actuator 441 can be remotely operated by a user or operator of the watercraft 100 to extend and/or retract the actuator. In so doing, the tilt assembly 440 operates to tilt the drive unit 420 relative to the watercraft.

Figure 16:
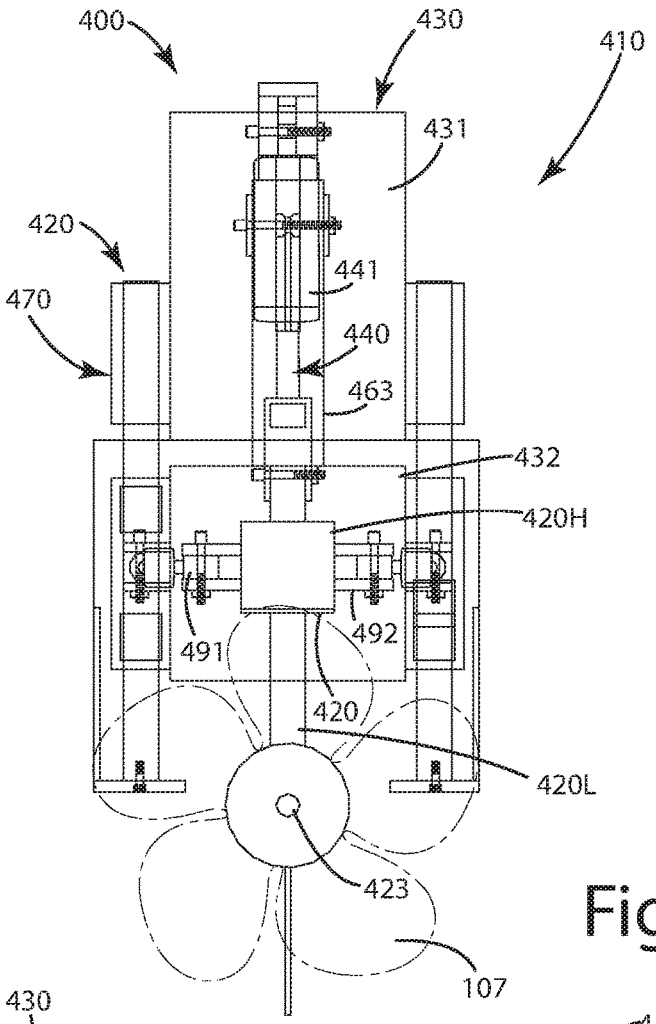
FIG. 16 is a rear view thereof.

Optionally, the outdrive 410 can include a guide assembly 460. This guide assembly can include a column 463 that is fixedly joined to the lower standoff box unit 432 as shown in FIGS. 15, 16 and 18. This column can define a slot 461. A v-track cam follower can be secured with a cam follower bolt 462 that is journaled in the slot 461. This bolt also can be secured to a guide bracket 460B that is fixedly, securely and immovably attached to the rear wall 431R of the upper standoff box unit 431. Thus, with this configuration, the v-track cam follower can operate to linearly guide the column 463 as the lower unit is raised to the position shown in FIG. 15 and/or lowered to the position shown in FIG. 19. In this manner, the components of the drive unit 420 maintain alignment with the components of the standoff box 430 in the respective assemblies. Of course, other guide assemblies could be substituted for the one shown. With the particular actuator 441, the guide assembly and its attachment to the drive unit 420, the bracket 443 can be the particular bracket 443 including the cylinder or sleeve 443C that rotatably fits on the spindle 493S of the guide assembly 460. Again, this construction can facilitate smooth turning and rotation of the drive unit 420 relative to the standoff box 430. It will also be appreciated that the upper bracket 443 attached to the actuator 440 is movable relative to the top surface 431T of the standoff box 430. For example, as shown in FIG. 15, the bracket 443 and the top of the sleeve 443C are almost in the same plane P3. When, however, the drive unit 420 is lowered, the bracket 443 and its sleeve 443C move a distance D10 downward and below the top wall 431T and plane P3 of the standoff box upper unit 431. The upper or top surface 420T and the actuator 441, however, even during this raising and lowering, can be maintained at a predetermined angle G relative to one another, assuming the tilt actuator 441 is not actuated to tilt that drive unit 420. Likewise, the angle G can be maintained even as the drive unit 420 is rotated in direction F3 during a turning operation, or in an opposite direction.

As mentioned above, the outdrive 410 can include a vertical spacing assembly 470. This vertical spacing assembly optionally can be joined with the upper standoff box unit 431 and the lower standoff box unit 432. The assembly can include hydraulic, pneumatic or other extendable and retractable elements, or a set of gears to move the upper and lower units relative to one another, and in particular up-and-down to the raised and lowered modes of the respective FIGS. 15 and 19. The actuators of this assembly can be similar to any of the other vertical assembly actuators described herein, and therefore will not be described again in detail here.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

The above description is that of current embodiments of the invention. Various alterations and changes can be made without departing from the spirit and broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, and any combination of X, Y and Z, for example, X, Y, Z; X, Y; X, Z; and Y, Z.

The embodiments of the invention in which an exclusive property or privilege is claimed are defined as follows:

1. An outdrive for a watercraft having an inboard engine, the drive comprising:

an input shaft extending through a hole defined by a transom of the watercraft, a split standoff box disposed rearward of the transom and joined with the transom, the split standoff box including an upper standoff box unit and a lower standoff box unit, the input shaft extending into an interior of the upper standoff box unit;

a transfer shaft rotatably mounted in the interior of the upper standoff box unit, the transfer shaft disposed transverse to the input shaft, the transfer shaft rotatable in response to rotation of the input shaft, the transfer shaft including a transfer shaft longitudinal axis;

a propeller shaft rotatable upon rotation of the transfer shaft; and a propeller joined with the propeller shaft and adapted to rotate therewith, thereby producing thrust to propel the watercraft through a body of water;

wherein the outdrive is operable in a raised mode, in which the lower standoff box unit is disposed adjacent the upper standoff box unit, and in a lowered mode, in which the lower standoff box unit is distal from the upper standoff box unit.

2. The outdrive of claim 1 wherein in both the raised mode and the lowered mode, the propeller shaft is maintained at a fixed angle relative to a reference line projecting rearward from a bottom of the transom of the watercraft.

3. The outdrive of claim 1 comprising:

a ball spline non-rotatably fixed to the transfer gear, the transfer shaft movable linearly relative to the ball spline axis so that the transfer shaft longitudinal axis can move linearly relative to the transfer gear.

4. The outdrive of claim 1 comprising:

wherein in the raised mode, lower standoff box unit is disposed a first distance from the upper standoff box unit, and in a lowered mode, the lower standoff box unit is disposed a second distance, greater than the first distance, from the upper standoff box unit.

5. The outdrive of claim 1 comprising:

a first gear nonrotatably joined with the transfer shaft in the upper standoff box unit, a second gear nonrotatably joined with the propeller shaft in a torpedo housing located under the lower standoff box.

6. The outdrive of claim 1, wherein the transfer shaft is disposed within an enclosure between the upper standoff box unit and the lower standoff box unit, whereby the enclosure prevents at least one of oil and grease on the transfer shaft from entering water within which the outdrive is located.

7. The outdrive of claim 1, comprising:

a first steering actuator joined with a first side of the lower standoff box unit; and a second steering actuator joined with an opposing second side of the lower standoff box unit.

8. The outdrive of claim 7, wherein the first and second steering actuators are each hydraulic rams.

9. The outdrive of claim 1, wherein the upper standoff box unit includes a bottom wall defining a bottom wall hole, wherein the transfer shaft is disposed through the wall hole, wherein the transfer shaft moves linearly through the hole when the outdrive translates from the raised mode to the lowered mode.

10. The outdrive of claim 9, comprising:

a column joined with the lower standoff box unit and extending upward adjacent the upper standoff box unit, and a tilt actuator joined with the column.

11. A standoff box for a watercraft having an inboard engine, the standoff box comprising:

a first housing defining an interior, the first housing including a transom facing wall, a first bottom wall and a first rearward wall, the transom facing wall defining an input shaft hole adapted to receive therethrough an input shaft extending from an inboard motor, the bottom wall defining a bottom wall hole;

a second housing including a second forward wall, an upper wall, and a second rearward wall, the upper wall defining an upper wall hole;

a transfer shaft rotatably mounted in the first housing, extending through the bottom wall hole, and extending into the second housing through the upper wall hole, the transfer shaft disposed transverse to the input shaft when the input shaft is received by the input shaft hole, the transfer shaft configured to rotate in response to rotation of the input shaft, the transfer shaft including a transfer shaft longitudinal axis; and wherein the second housing is movably disposed below the first housing such that the upper wall of the second housing moves away from the bottom wall of the first housing to a distal position when the second housing is lowered, and such that the upper wall moves toward the bottom wall of the first housing to a proximal position when the second housing is raised.

12. The standoff box of claim 11, comprising:

a ball spline non-rotatably fixed to the transfer shaft, the ball spline disposed in the first housing.

13. The standoff box of claim 11, comprising:

a double articulating joint joined with the transfer shaft, the double articulating rotatably disposed in the second housing.

14. The standoff box of claim 11 comprising:

an enclosure disposed between the first housing and the second housing and surrounding the transfer shaft, whereby the enclosure prevents at least one of oil and grease on the transfer shaft from entering water within which the outdrive is located.

15. The standoff box of claim 11, wherein the transfer shaft moves linearly through at least one of the bottom wall hole and the upper wall hole when the second housing moves away from the bottom wall of the first housing.

16. A watercraft comprising:

a hull including a bow and a stern, with a transom located at the stern;

a reference line projecting rearward from a lowermost portion of the transom;

an engine disposed in the hull;

an input shaft extending away from the engine;

a first standoff box unit including an interior and a bottom wall, the first standoff box unit being joined with the transom;

a second standoff box unit joined with and movable relative to the first standoff box unit;

a transfer shaft rotatably mounted in the interior and rotatably coupled to the input shaft, the transfer shaft further extending into the second standoff box unit;

a propeller shaft and a propeller, the propeller shaft configured to rotate upon rotation of the transfer shaft;

wherein the second standoff box unit is operable in a raised mode, in which the second standoff box unit is disposed adjacent the first standoff box unit, and in a lowered mode, in which the second standoff box unit is distal from the first standoff box unit, while the watercraft is moving through a body of water, and while the propeller is rotating so as to move the propeller shaft relative to the reference line while maintaining the propeller shaft in a fixed angular relationship relative to the reference line.

17. The watercraft of claim 16 comprising:

a ball spline rotatably mounted in the first standoff box unit, the ball spline including an internal bore;

wherein the transfer shaft is disposed within the internal bore of the ball spline, wherein the transfer shaft is linearly movable through the ball spline, but rotationally fixed relative to the ball spline so that the ball spline rotates in unison with the transfer shaft.

18. The watercraft of claim 16, wherein the first standoff box unit bottom wall defines a bottom wall hole, wherein the second standoff box unit includes an upper wall defining an upper wall hole, wherein the transfer shaft moves linearly through at least one of the bottom wall hole and the upper wall hole when the second standoff box unit moves away from the bottom wall of the first standoff box unit.

19. The watercraft of claim 16, comprising:

a tilt actuator joined with a bracket including a sleeve;

a column joined with the second standoff box unit, wherein the sleeve is rotatably mounted relative to the column.

20. The watercraft of claim 19, wherein the sleeve and spindle move relative to an upper wall of the first standoff box unit when the propeller shaft moves relative to the reference line.

* * * * *